US006289802B1

(12) United States Patent
Zelko

(10) Patent No.: US 6,289,802 B1
(45) Date of Patent: Sep. 18, 2001

(54) SCREEN PRINTING MACHINES

(76) Inventor: Steve Zelko, P.O. Box 213, Tanaka, Golden Bay (NZ)

( * ) Notice: Subject to any disclaimer, the term of this patent is extended or adjusted under 35 U.S.C. 154(b) by 0 days.

(21) Appl. No.: 09/591,900

(22) Filed: Jun. 12, 2000

Related U.S. Application Data

(63) Continuation-in-part of application No. 09/076,821, filed on May 13, 1998, now Pat. No. 6,089,149.

(51) Int. Cl.[7] ..... B41F 15/04
(52) U.S. Cl. ..... 101/115; 101/126
(58) Field of Search ..... 101/35, 43, 44, 101/114, 115, 123, 126, 129

(56) References Cited

U.S. PATENT DOCUMENTS 4,909,146 3/1990 Szarka ..... 101/126
5,031,527 7/1991 Eppinger ..... 101/115

*Primary Examiner*—Ren Yan
(74) *Attorney, Agent, or Firm*—Thomas R. Trempus

(57) ABSTRACT

A screen printing machine has article supports for articles to be printed, a displacement mechanism for displacing the article supports in succession around an endless path of travel and printing stations distributed along the path of travel and each having a printing head. The displacement mechanism has drive members engageable with the article supports for displacing the article supports, a reciprocating drive operable to reciprocate the drive members to and fro along the endless path to advance the articles in succession to the printing stations, and actuating devices for displacing the drive members into and out of engagement with the article supports. The article supports are vacuum tables communicating with a vacuum duct through a member sliding between flexible members extending along the duct.

6 Claims, 24 Drawing Sheets

172
160
110
108
106
112
118
116
114
110
172

SCREEN PRINTING MACHINES

CROSS-REFERENCE TO RELATED APPLICATION

This application is a continuation-in-part of U.S. patent application Ser. No. 09/076,821, entitled "Screen Printing Machines", filed May 13, 1998, now U.S. Pat. No. 6,089,149.

BACKGROUND OF THE INVENTION

1. Field of the Invention

The present invention relates to screen printing machines and, more particularly, to screen printing machines of the type which employ a plurality of article supports, e.g pallets or vacuum tables, for carrying articles to be printed, the article supports being displaceable around an endless path in succession through a plurality of printing stations each provided with a printing head.

2. Description of the Related Art

It has previously been known to provide a screen printing machine of the above-mentioned type having an endless chain for pulling the article supports around the endless path. Since it is important to ensure that the articles to be printed, which are carried on the article supports, are accurately located in position at the printing stations beneath the printing heads, locating devices have been provided at the printing stations for engaging and accurately positioning the vacuum tables. One such screen printing machine is disclosed in my co-pending U.S. patent application Ser. No. 08/939,497, filed Sep. 29, 1997, the disclosure of which is incorporated herein by reference.

However, it is a substantial disadvantage of chain-driven printing machines that the drive chain, over the course of time, tends to stretch, causing inaccuracy and possible disruption of the printing process.

It is also well known in the art to employ vacuum tables for supporting paper, plastic and other articles, known as flat stock, as the vacuum tables are advanced from station to station around an endless path.

It is an object of the present invention to provide a printing machine having a novel and improved mechanism for displacing the article supports for the articles to be printed to successive printing stations.

BRIEF DESCRIPTION OF THE INVENTION

According to the present invention, a screen printing machine has a displacement mechanism which is provided for displacing a plurality of article supports in succession around an endless path of travel, with printing stations distributed along the path and each having a printing head. The displacement mechanism comprises drive members engageable with the article supports for displacing the article supports along the path, a reciprocating drive operable to reciprocate the drive members to and fro along the path and actuating devices for moving the drive members into and out of engagement with the article supports.

By the to-and-fro movement of the drive members, the article supports are advanced in succession to the printing stations, at which printing on the article supports is performed.

By using the reciprocating drive, the present invention avoids the disadvantages of prior art endless chain drives from displacing articles to successive printing stations.

The reciprocating drive preferably comprises elongate members and pivots connecting the elongate drive members, the elongate drive members and the pivots forming a drive connection between the prime mover and the drive members.

In a preferred embodiment of the invention, the endless path includes a pair of parallel elongate straight path sections, tracks extending along the straight path sections and a pair of carriages carried on the tracks, the drive members being mounted on the tracks and the reciprocating drive being connected to the carriages for displacing the carriages to and fro, in opposite directions, to one another, along the tracks.

The drive members are arranged in pairs spaced apart transversely of the path and each of the supports has leading and trailing pairs of projections to facilitate transfer of the article supports between the straight path sections.

In an alternative embodiment of this invention, an improved vacuum delivery system provides the vacuum tables with continuous access to an endless vacuum duct.

BRIEF DESCRIPTION OF THE DRAWINGS

The present invention will be more readily understood from the following description thereof when taken in conjunction with the accompanying drawings, in which.

DESCRIPTION OF THE PREFERRED EMBODIMENT

Figure 1:
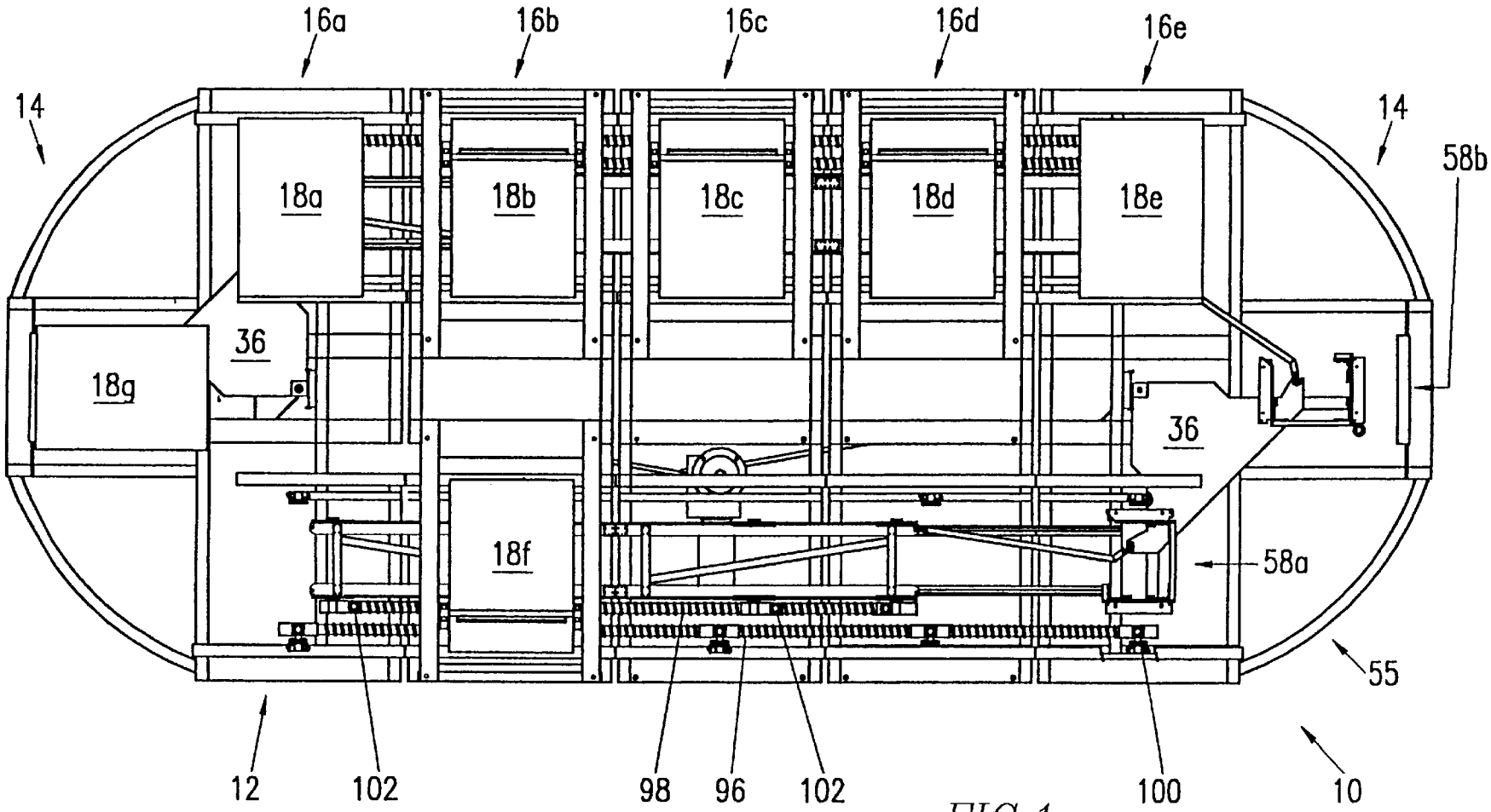
FIG. 1 shows a plan view of parts of a screen printing machine embodying the present invention.

Referring firstly to FIG. 1 of the accompanying drawings, there is shown a screen printing machine indicated generally by reference numeral 10, which is intended for printing flat stock and which has a machine frame indicated generally by reference numeral 12. The machine frame 12 has opposite end sections indicated generally by reference numerals 14 and intermediate sections indicated generally by reference numerals 16*a*–16*e*. Each of the intermediate sections 16*a*–16*e* has two printing stations, as described in more detail below. The number of these intermediate sections 16*a*–16*e* can be varied in order to correspondingly vary the number of printing stations in the screen printing machine FIG. 1 also shows seven article supports in the form of vacuum tables 18*a*–18*g* which, in operation of the machine, are advanced stepwise around a horizontal endless path, as will also be apparent from the following description, by means of a support displacement mechanism, components of which will now be described to reference FIGS. 2 through 4. The machine 10 is normally equipped with a further five similar vacuum tables, which have been omitted from the drawings in order to facilitate the illustration of the machine 10.

Figure 2:
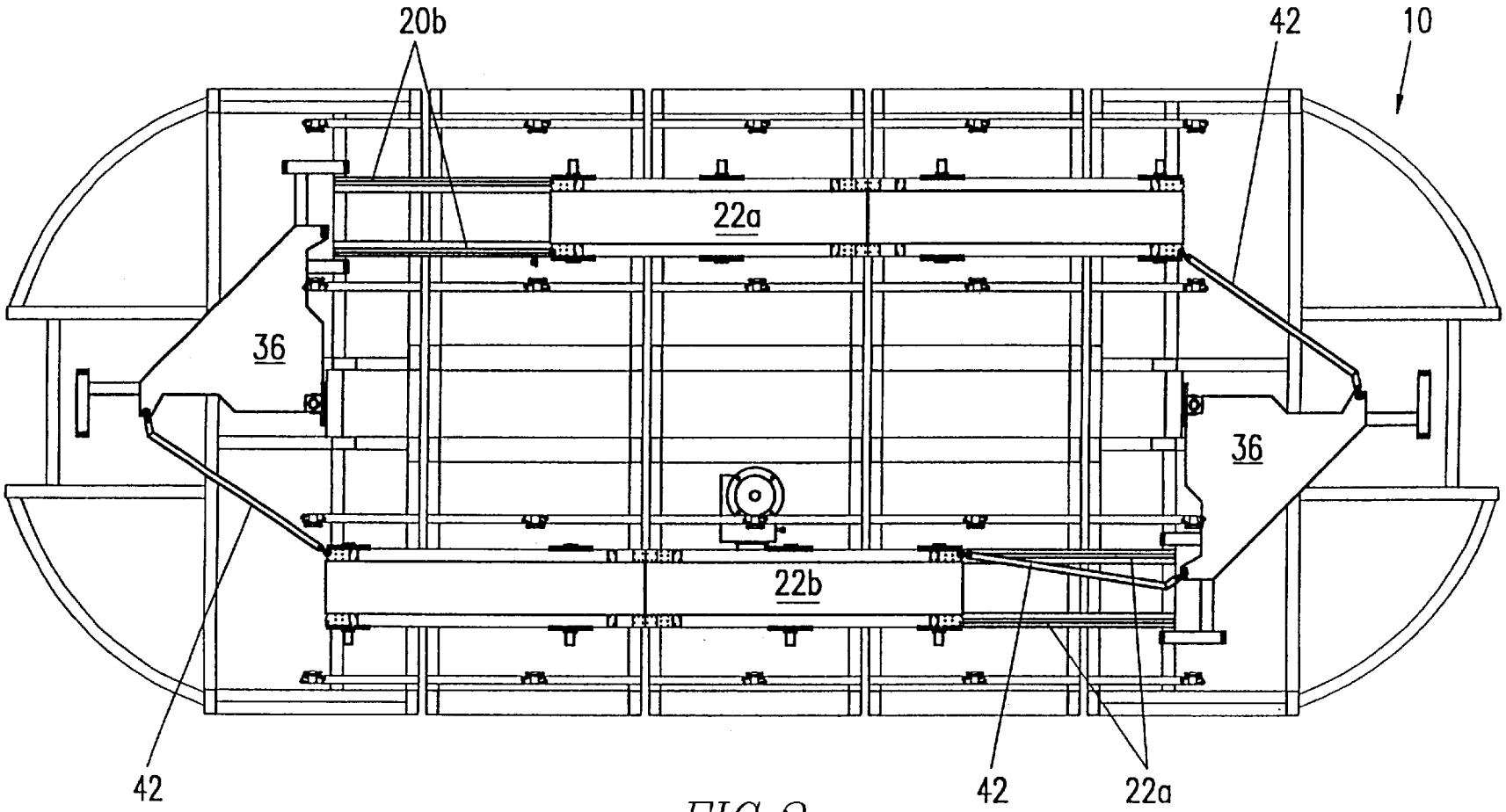
FIG. 2 shows a plan view corresponding to FIG. 1, but with some of the parts of the machine omitted.

The endless path of travel of the article supports 18*a*–18*g* through the screen printing machine 10 includes two parallel elongate straight path sections, each defined by a pair of rails 20*a*, 20*b* (FIG. 2). A pair of reciprocatable carriages 22*a*, 22*b* are mounted on the rails 20*a*, 20*b* for movement to and fro along the rails 20*a*, 20*b*. For this purpose, a reciprocating displacement mechanism is provided, which includes a prime mover in the form of an electric motor 24 (FIG. 4) which is mounted in the machine frame 12 and, more particularly, in the central intermediate section 16*c*. The electric motor 24 drives a gear box 26, containing a reduction gearing and the gear box 26, in turn, pivots a crank arm 28 to and fro. The crank arms 28 are connected by a first pair of connection rods 30 to a second pair of connection rods 32, with pivot connections 27 between the crank arms 28 and the connecting rods 30. Each connecting rod 30 is connected to its respective connecting rod 32 by means of a pivot connection 34, which is slidable along a rail 37 in a respective guide 38 fixedly secured to the machine frame 12.

Each connection rod 32 is connected, in turn, by a pivot connection 33 to a lever arm 35, which projects from a horizontally pivotable drive connector 36.

The crank arms 28, the connecting rods 30 and 32 and the lever arms 35 are thus elongate members which, with the pivot connections 27, 33 and 34, form a drive connection or linkage between the motor 34 and the drive connectors 36. The drive connectors 36 are each formed of a plate of generally triangular shape, which is pivotable to and fro in a horizontal plane about a vertical pivot axis of a respective pivot shaft 40 mounted on the machine frame 12. When the electric motor 24 is energized to cause the crank arm 28 to pivot to and fro, the drive connectors 36 are each pivoted horizontally through 90° to and fro about their respective pivot shafts 40 between the positions in which they are shown in FIG. 2 and the positions in which they are shown in FIG. 3.

Figure 3:
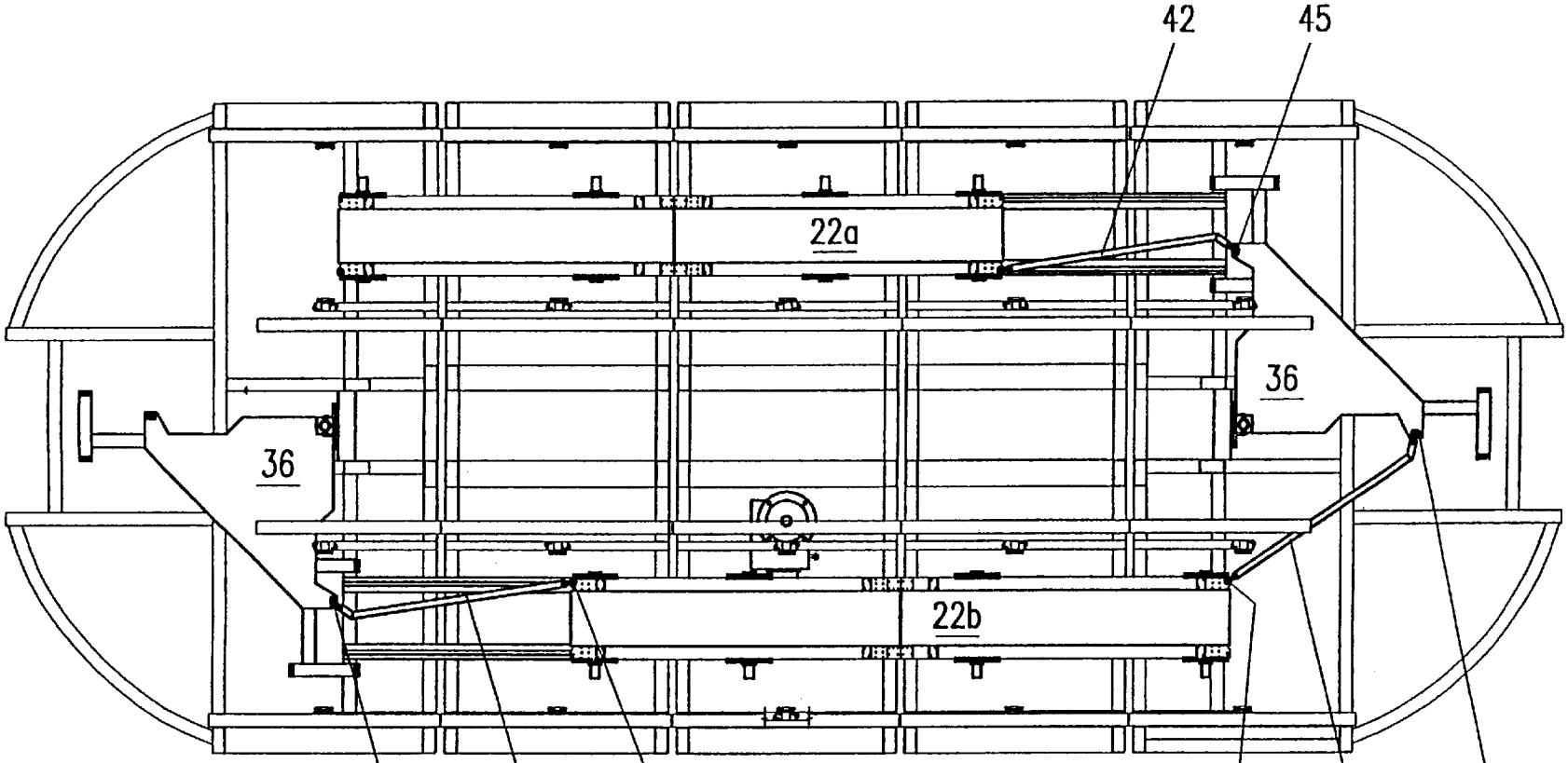
FIG. 3 shows a view corresponding to FIG. 2, but with parts of the machine moved into different positions.
Figure 4:
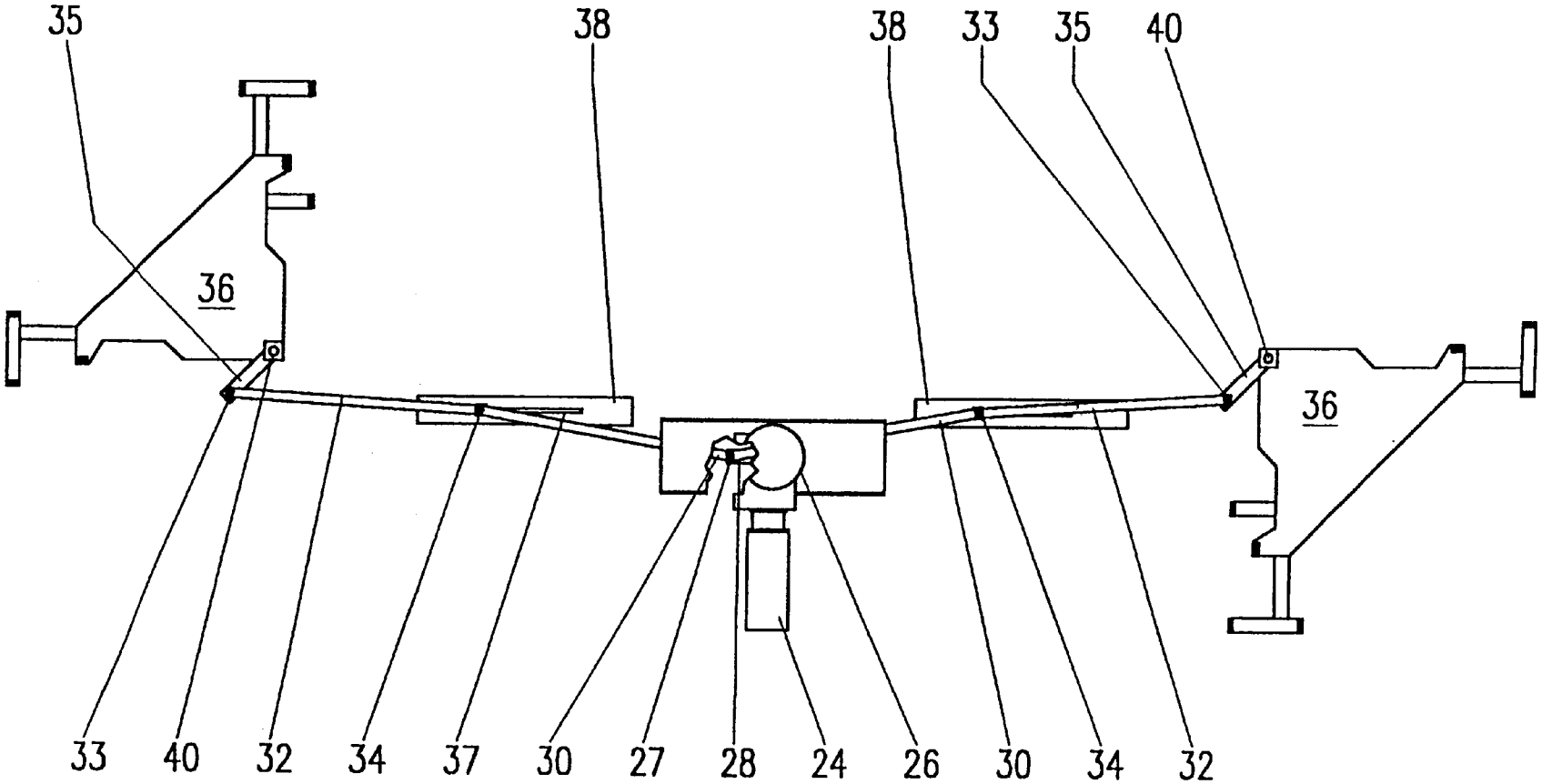
FIG. 4 shows a view corresponding to FIG. 2, but with further parts of the machine omitted to show components of an article support displacement mechanism.

As shown in FIGS. 2 and 3, the drive connectors 36 are connected by connecting rods or links 42 to the proximal ends of the reciprocatable carriages 22*a*, 22*b*. More particularly, the connecting rods 42 are connected by pivot connections 44 to the drive connectors 36 and by pivot connections 45 to the reciprocatable carriages 22*a*, 22*b*. Consequently, as the drive connectors 36 are pivoted to and fro about their pivot axis 40, the carriages 22*a*, 22*b* are correspondingly displaced to and fro, in opposite directions to one another, along the rails 20*a*, 20*b*. Thus, the arrangement is such that, as will be apparent from FIGS. 2 and 3, the carriage 22*a* is moved to the right, as viewed in these figures, as the table 22*b* is moved to the left, and vice versa. These components drivingly connecting the electric motor 24 to the carriages 22*a*, 22*b* are all parts of the above-mentioned reciprocating displacement mechanism.

It will be noted that the left-hand drive connector 36, as viewed in FIGS. 2 and 3, has only one connecting rod 42, by which it is connected to the carriage 22*b*. The omission of any connecting rod 42 between this drive connector 36 and the carriage 22*a* facilitates the reciprocation of the two carriages 22*a* and 22*b*.

Each of these pivotations of the drive connectors 36 to and fro through 90° causes a corresponding reciprocation of the carriages 22*a*, 22*b* through a predetermined distance corresponding to the distance from one to the next of the printing stations at each side of the machine. In this way, the article supports are advanced in steps to successive ones of the printing stations, as described below.

Figure 5:
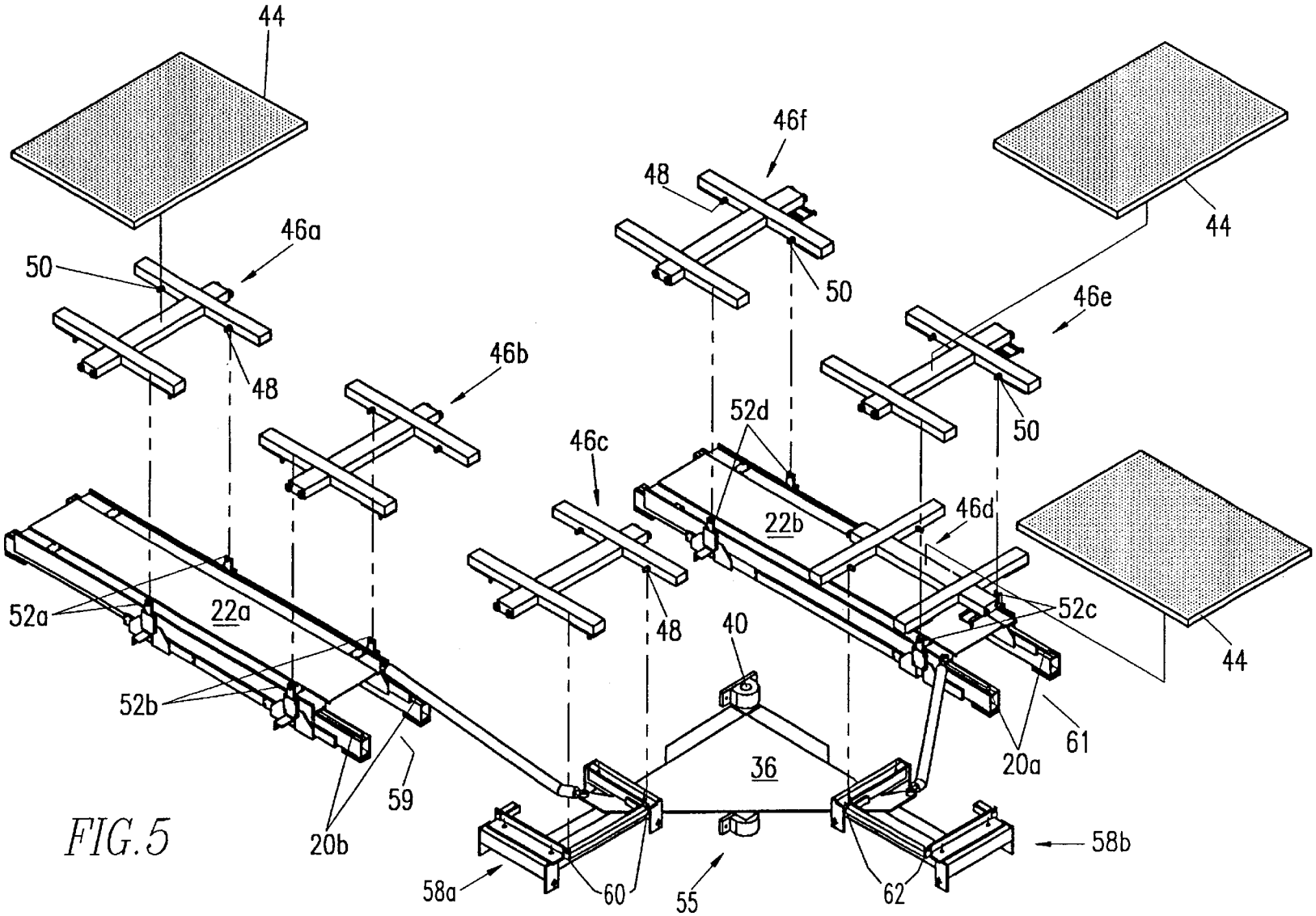
FIG. 5 shows an exploded view, in perspective, of components of the article support displacement mechanism of FIG. 4 and of article supports which are displaced by that mechanism.

FIG. 5 shows a broken-way exploded view of parts of the displacement mechanism and of the vacuum tables themselves.

More particularly, in FIG. 5, reference numerals 44 indicate three perforated table tops, the constructional details of which are described below. The table tops 44 are each fixedly secured to a respective generally H-shaped sub-structure, of which six are shown in FIG. 5 and indicated generally by reference numerals 46*a*–46*f*, and which are each provided with a pair of leading projections 48 and a pair of trailing projections 50. The carriages 22*a*, 22*b* are provided at opposite sides thereof with pairs of drive members, four pairs of which are indicated by reference numerals 52*a*–52*d*. The drive members 52*a*–52*d* can be raised into operative position, for driving engagement with the projections 48 and 50 or retracted downwardly, into inoperative position for disengaging the projections 48, 50, as described in greater detail below. The table tops 44 and the table sub-structures 46*a*–46*f* are supported by sliding contact of the table tops with track 56 (FIG. 6), which extend along opposite sides of the path of travel of the table tops 44 and are in turn supported on the machine frame 12.

Referring again to FIG. 5, the drive connector 36 forms part of a table transfer mechanism indicated generally by reference numeral 55, which includes two table transfer devices carried by the drive connector 36 and indicated, respectively, by reference numerals 58*a*, 58*b*. These table transfer devices 58*a*, 58*b* form pivotable supports and are disposed at right angles to one another.

To facilitate understanding of the manner in which the table sub-structures 46*a*–46*f* are engaged and advanced, chain-dot lines have been employed in FIG. 5 to illustrate the relationship between the drive members 52*a*–52*d* and the leading and trailing projections 48,50 of the table sub-structures 46*a*–46*f*.

The table transfer device 58*a*, as shown in FIG. 5, is in a first position in which it can engage the leading projections 48 of the table sub-structure 46*c* located at an output end 59 of the rails 20*b*. From this first position, the table transfer device 58*a*, carrying with it the table sub-structure 46*c*, is moved, on pivotation of the drive connector 36 through 90° about its pivot shaft 40, into an intermediate position, in which the table transfer device 58*b* is shown in FIG. 5. At the same time, the table transfer device 58*b* is pivoted through 90 degrees from the intermediate position, in which it is shown in FIG. 5, to a third position at an input end 61 of the rails 20*a*, above which the table sub-structure 46*e* is shown in FIG. 5.

More particularly, the drive members 52*a* and 52*b* are spaced apart along their carriages 22*a*, 22*b* so that the drive members 52*a* engage the leading projections 48 of the table sub-structure 46*a* and the drive members 52*b* engage the trailing projections 50 of the table sub-structure 46*b*. As the drive connector 36 is pivoted from the position in which it is shown in FIG. 5, through 90 degrees, the table sub-structure 46*b* will be advanced through a distance equal to the distance from one to the next of the printing stations, by driving engagement of the drive members 52*b* with the trailing projections 50 of the table sub-structure 46*b*, into the position in which the table sub-structure 46*c* is shown in FIG. 5. In this position, the drive members 52*b* are retracted downwardly out of engagement with the trailing projections 50 of the table sub-structure 46*b*, and drive members 60 on the table transfer device 58*a* are extended upwardly into engagement with the leading projections 48 of the table sub-structure. When the drive connector 36 is then pivoted through 90 degrees from the position in which it is shown in FIG. 5, the table transfer device 58*a* drives the table sub-structure from the first position to the intermediate position, and the drive members 60 are then retracted downwardly to release the table sub-structure in the intermediate position.

Prior to this pivotation of the drive connector 36, drive members 62 on the table transfer device 58*b* are extended upwardly into engagement with the trailing projections 50 of the table sub-structure in this intermediate position. Consequently, when the drive connector 36 pivots from its position shown in FIG. 5, this table sub-structure is advanced from the intermediate position to the third position, at the input end 61 of the rails 20*a*.

As this occurs, the preceding table sub-structure is moved along the rails 20*a* from the third position by the drive members 52*c* in engagement with the trailing projections 50 of that table sub-structure and, simultaneously, the drive members 52*d*, which have been raised into engagement with the trailing projections 50 of the table sub-structure 46*f*, displace the latter along the rails 20*a*.

Figure 6:
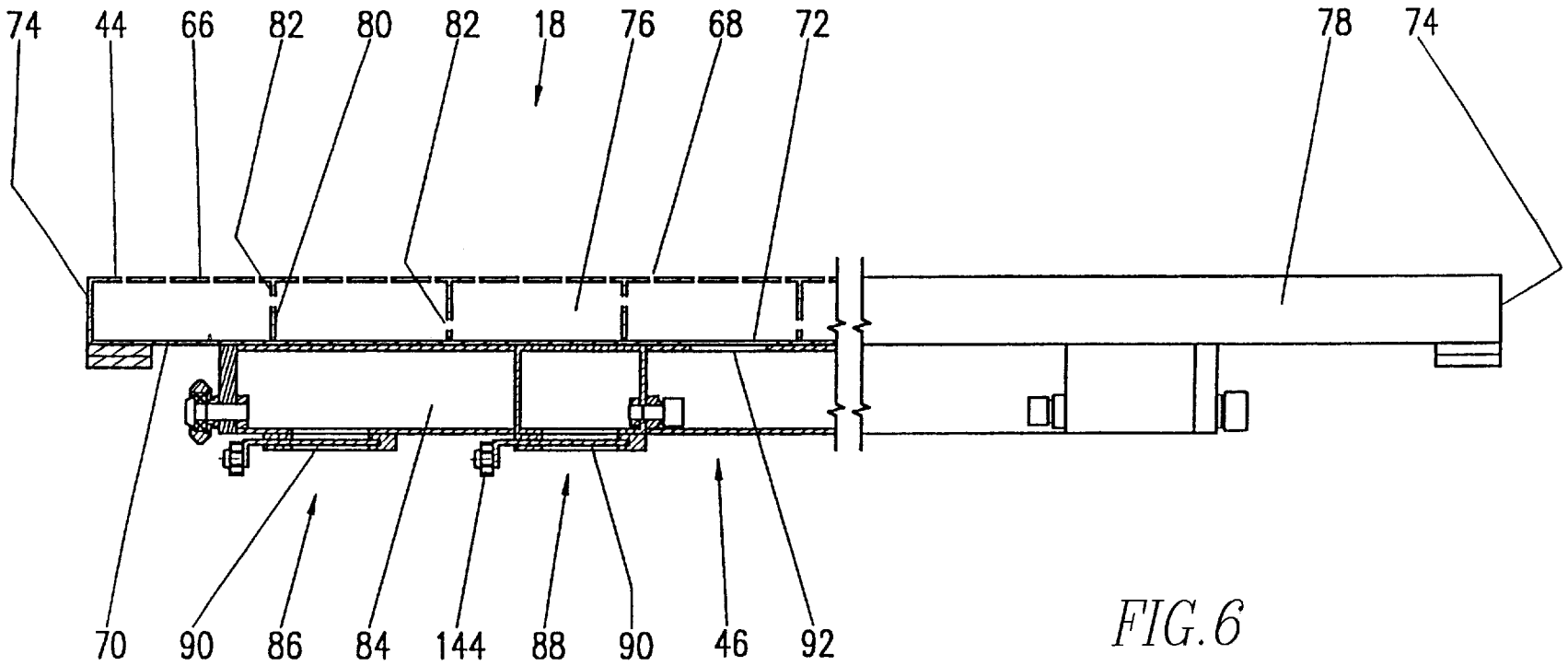
FIG. 6 shows a view, partly in cross-section, through an article support used in the machine of FIGS. 1 through 5.

FIG. 6 shows in greater detail the construction of one of the vacuum tables, which is indicated generally by reference numeral 18, and it is to be understood that the vacuum table 18 is similar in construction to vacuum tables 18*a*–18*g* and that, in practice, the machine 10 is normally provided with twelve vacuum tables as indicated above, and that they are all similar to one another.

As shown in FIG. 6, the vacuum table 18 includes one of the table tops 44, which has a hollow interior defined by a top 66, formed with perforations 68, a bottom 70, formed with an opening 72, opposite side walls 74, an end wall 76 and an opposite end wall 78. For reinforcement, the interior of the table top 44 is provided with an internal honeycomb structure formed by partitions 80, and the partitions 80 are formed with openings 82.

The table sub-structure, which in this Figure is indicated generally by reference numeral 46 and which is similar to the table sub-structures 46*a*–46*f* of FIG. 5, has a hollow interior 84 and vacuum ports indicated generally by reference numerals 86 and 88, which are normally closed by slidable closure members 90.

The vacuum ports 86 are stationary and the vacuum ports 88 are mounted on the carriages 22*a* and 22*b* for reciprocation therewith. When one of these vacuum ports 86 and 88 is opened and a vacuum is applied to the opened port, as described below, the vacuum is communicated through the hollow interior 84 of the table sub-structure 46, through an opening 92 in the top of the latter and through an opening 72 in the bottom 70 of the table top 44 to the perforations 68. In this way, an article of flat stock which is to be printed is held firmly by vacuum on the top of the table top 44.

The end sections 14 are provided with stationary vacuum ports 87 and movable vacuum ports 89 are mounted on the drive connectors 36 for to-and-fro pivotation therewith.

Figure 7:
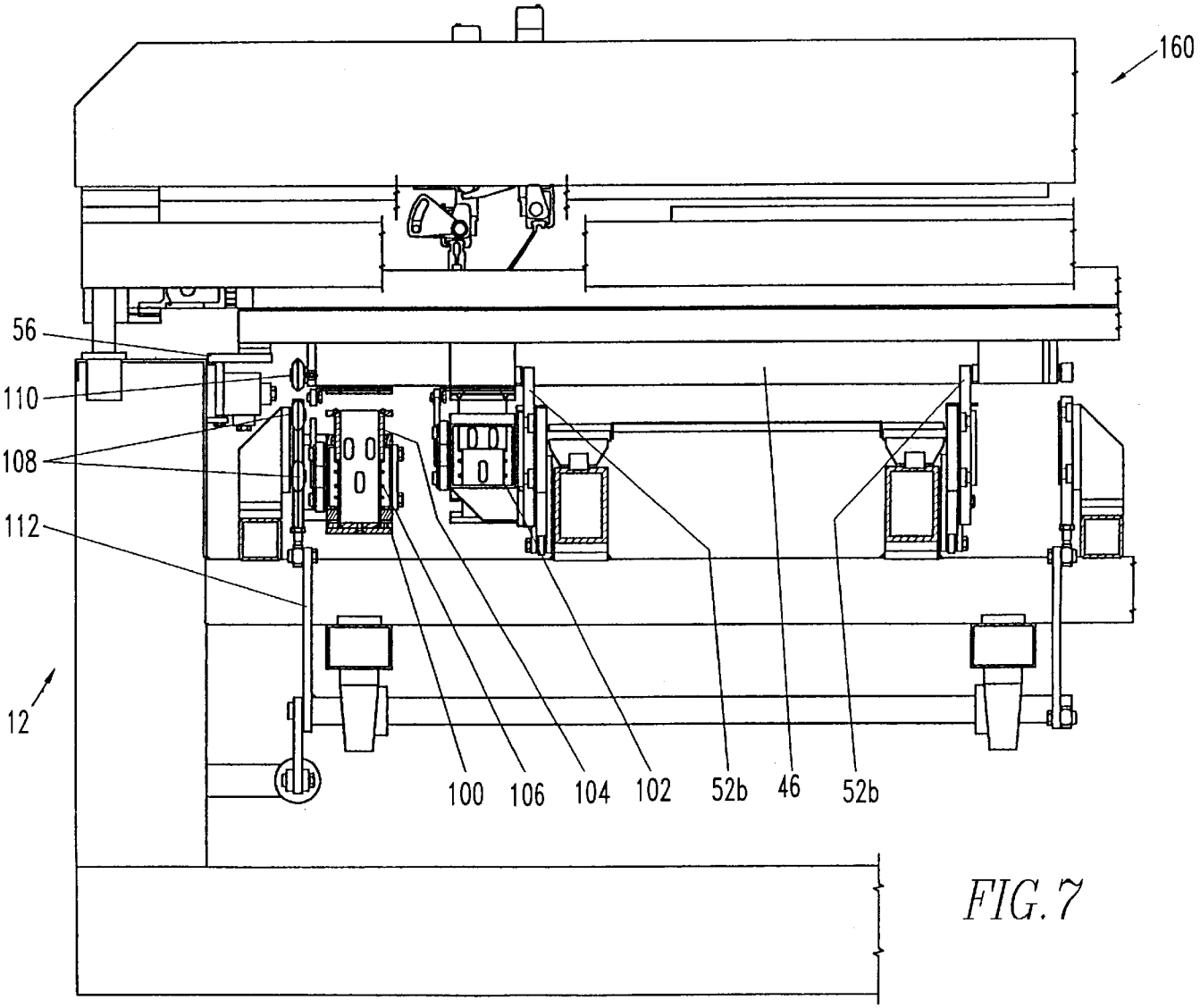
FIG. 7 shows a broken-away view taken partly in cross-section through a printing station of the machine of FIGS. 1 through 5.

Referring again to FIG. 1, it will be seen that the machine 10 includes a stationary vacuum duct 96 extending along each pair of rails 20*a*, 20*b* and also a movable vacuum duct 98, which is secured to the respective carriage 22*a*, 22*b*. The vacuum ducts 96 and 98 are provided with vacuum connectors 100 and 102, one each of which is shown in FIG. 7.

The vacuum connector 100 has an open-top tube 104 which can be lowered into an inoperative position against the action of a compression spring 106 and raised, into engagement with an overlying one of the vacuum ports 86 for applying a vacuum from the vacuum duct 96 to the overlying table sub-structure 46.

Figure 14:
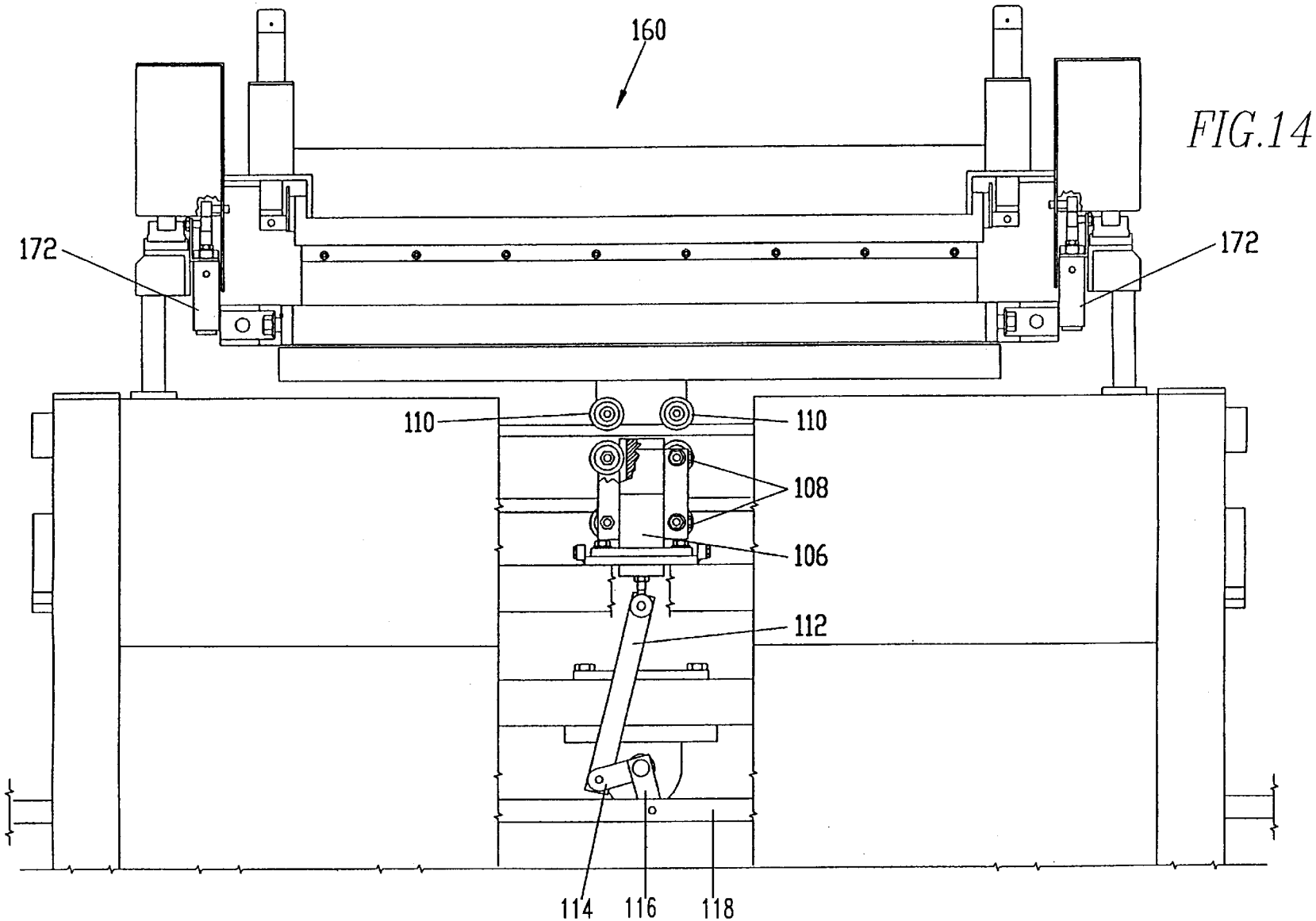
FIG. 14 shows a broken-away view, in side elevation, of one of the printing stations of the machine of FIGS. 1 through 13.

The tube 104 is secured for movement with a vertically elongate, vertically displaceable alignment member 106 (FIG. 14), which is guided by means of rollers 108 mounted on the machine frame and which, when raised, engages between rollers 110 on the table sub-structure 46 for locating the latter in position at the printing station for correct alignment during printing. The vertical displacement of the alignment member 106 and, therewith, the tube 104 is effected by means of a lever linkage comprising levers 112, 114 and 116 connected to a rod 118, which is horizontally reciprocatable, by means of a pneumatic piston and cylinder 120 (FIG. 8) connected to the machine frame.

Figure 12:
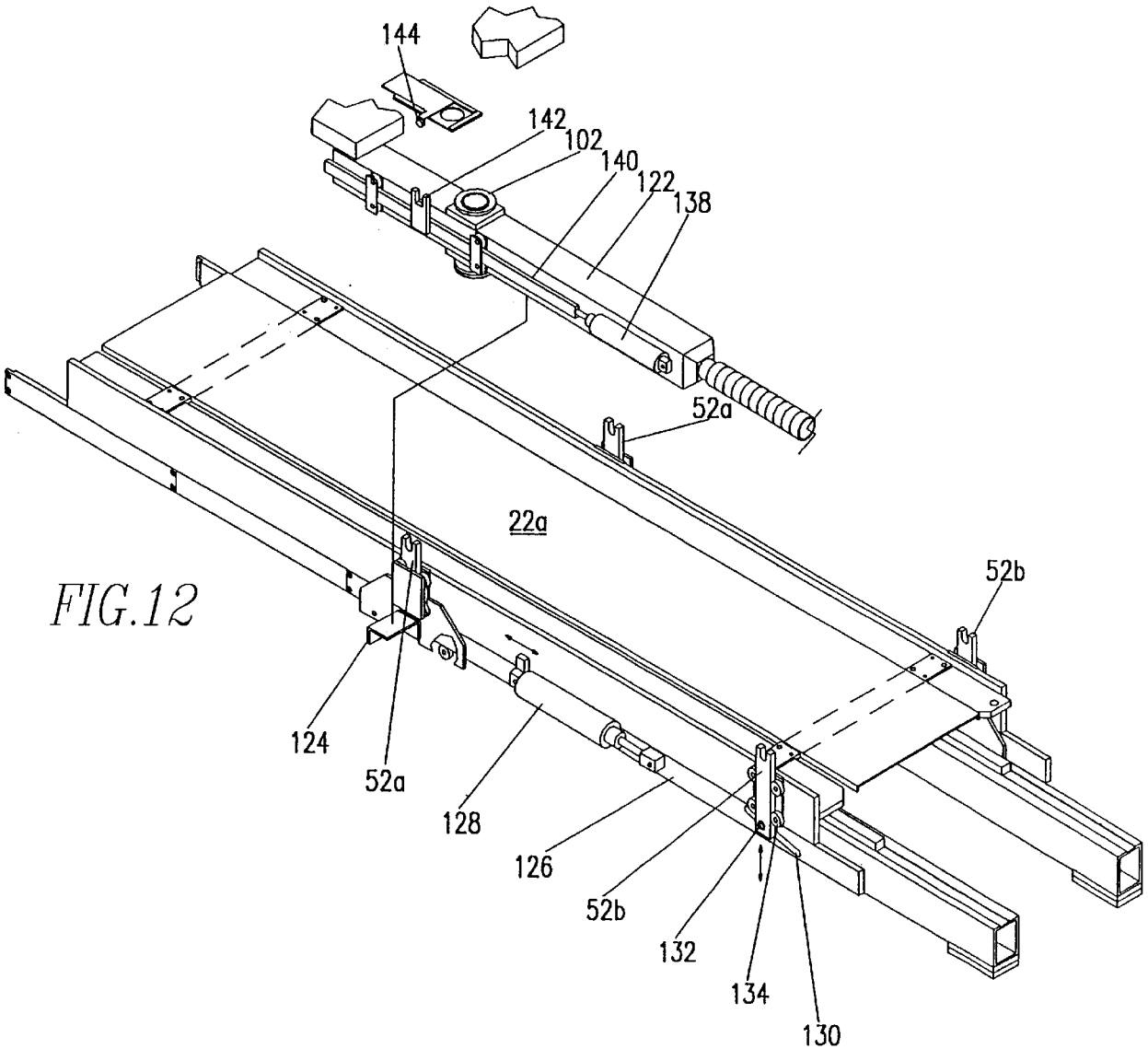
FIG. 12 shows a partly-exploded, broken-away view in perspective of parts of a carriage and a vacuum ducting system of the machine of FIGS. 1 through 11.

As shown in FIG. 12, the vacuum connector 102 is provided in a duct section 122, which is mounted on a support bracket 124 carried by the carriage 22*a*. A similar arrangement is mounted on the carriage 22*b*. The bracket 124 is mounted on the drive member 52*a*. A bar 126 can be displaced to and fro, in a horizontal direction, relative to the carriage 22*a* by means of a pneumatic piston-and-cylinder device 128. The bar 126 is provided with inclined slots, of which only one is shown and is indicated by reference numeral 130, into which engage pins 132 on the drive members 52*a* and 52*b*, which are mounted in guide rollers 134 so as to be vertically movable, to and fro, relative to the carriage 22*a* into and out of driving engagement with the projections 48 and 50 in accordance with the displacement of the bar 126 relative to the carriage 22*a*. The bracket 124 is secured to one of the drive members 52*a* for vertical movement therewith, and this vertical movement serves to move the vacuum connector 102 into and out of engagement with the vacuum port 88. During this vertical upward movement of the vacuum connector 102, a pneumatic piston-and-cylinder device 138 on the vacuum duct section 122 is employed to effect horizontal displacement of a bar 140, carrying a drive member 142, which engages a roller 144 on the closure member 90 of the port 88 in order to open this port 88.

Figure 8:
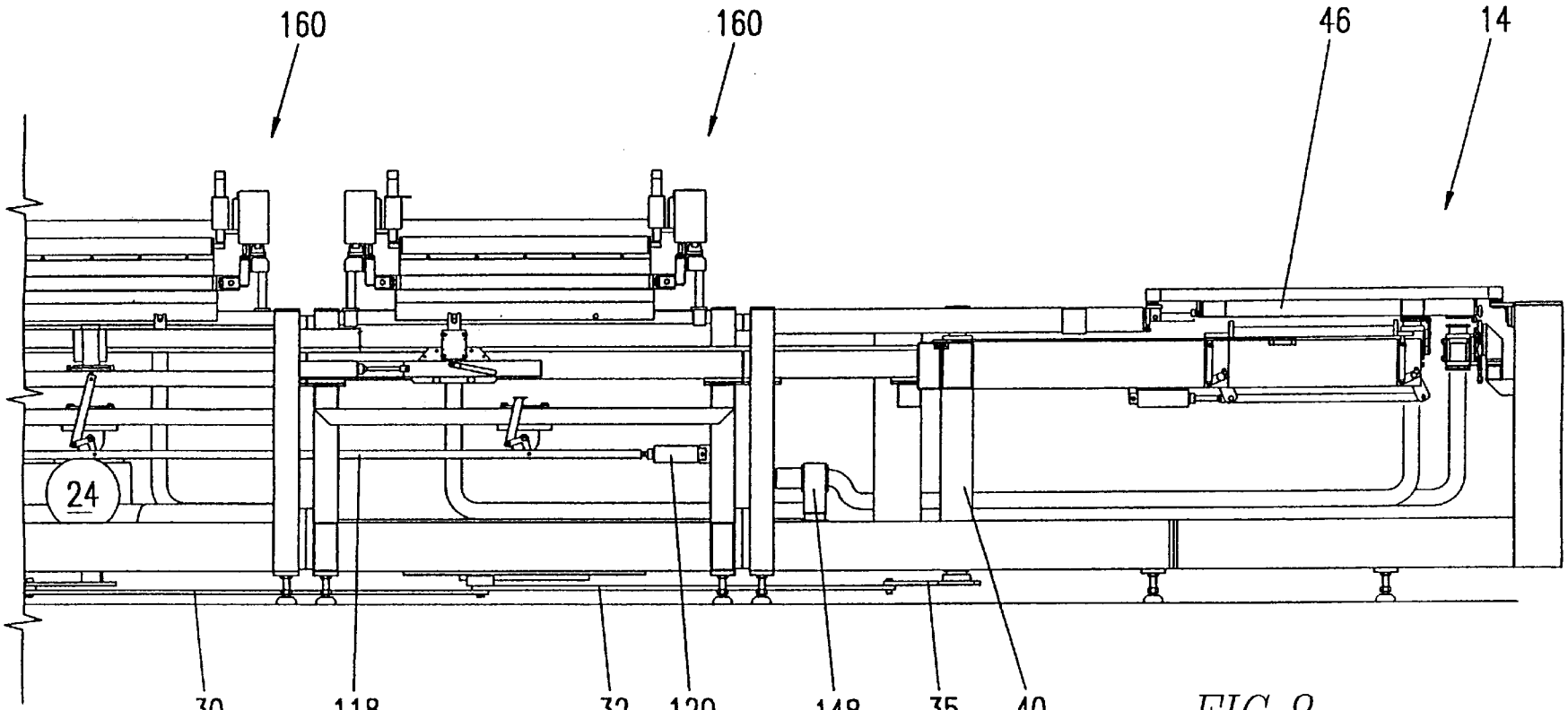
FIGS. 8 and 9 show broken-away views, in side elevation, of respective halves of the screen printing machine of FIG. 1.
Figure 9:
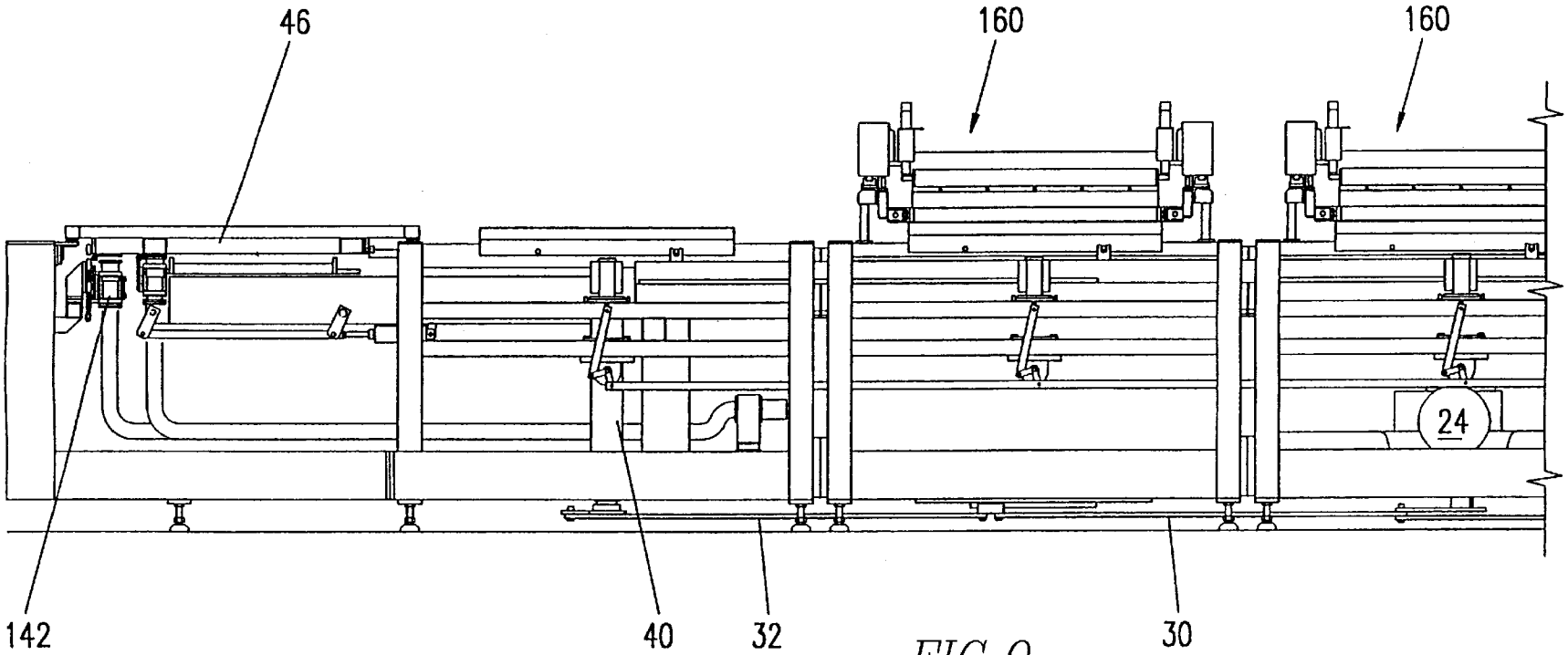
Figure 10:
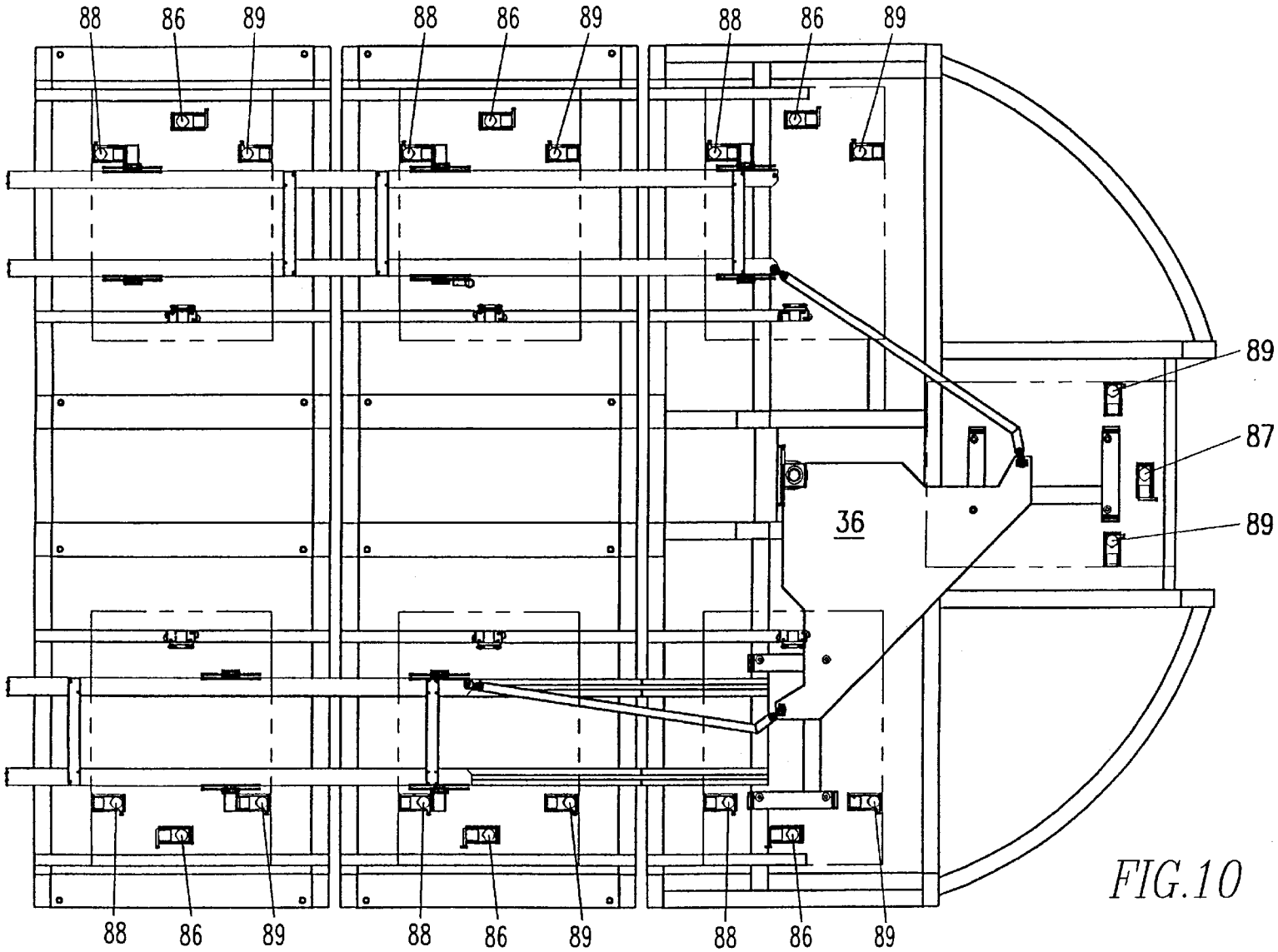
FIG. 10 shows a broken-away plan view of parts of the screen printing machine of FIG. 1.

Each of the table sub-structures 46, as shown in FIG. 10, is provided with two of the vacuum connectors 102, so that one of these vacuum connectors can be connected to the vacuum duct 98 during movement of the table sub-structure to the transfer mechanism 55, while the other port 105 is then available for connection 142 for use during the transfer of this table sub-structure 46 from the first position to the intermediate position, as described above. The vacuum ducts 96 and 98 are connected to a vacuum pump 148 (FIG. 8).

Figure 11:
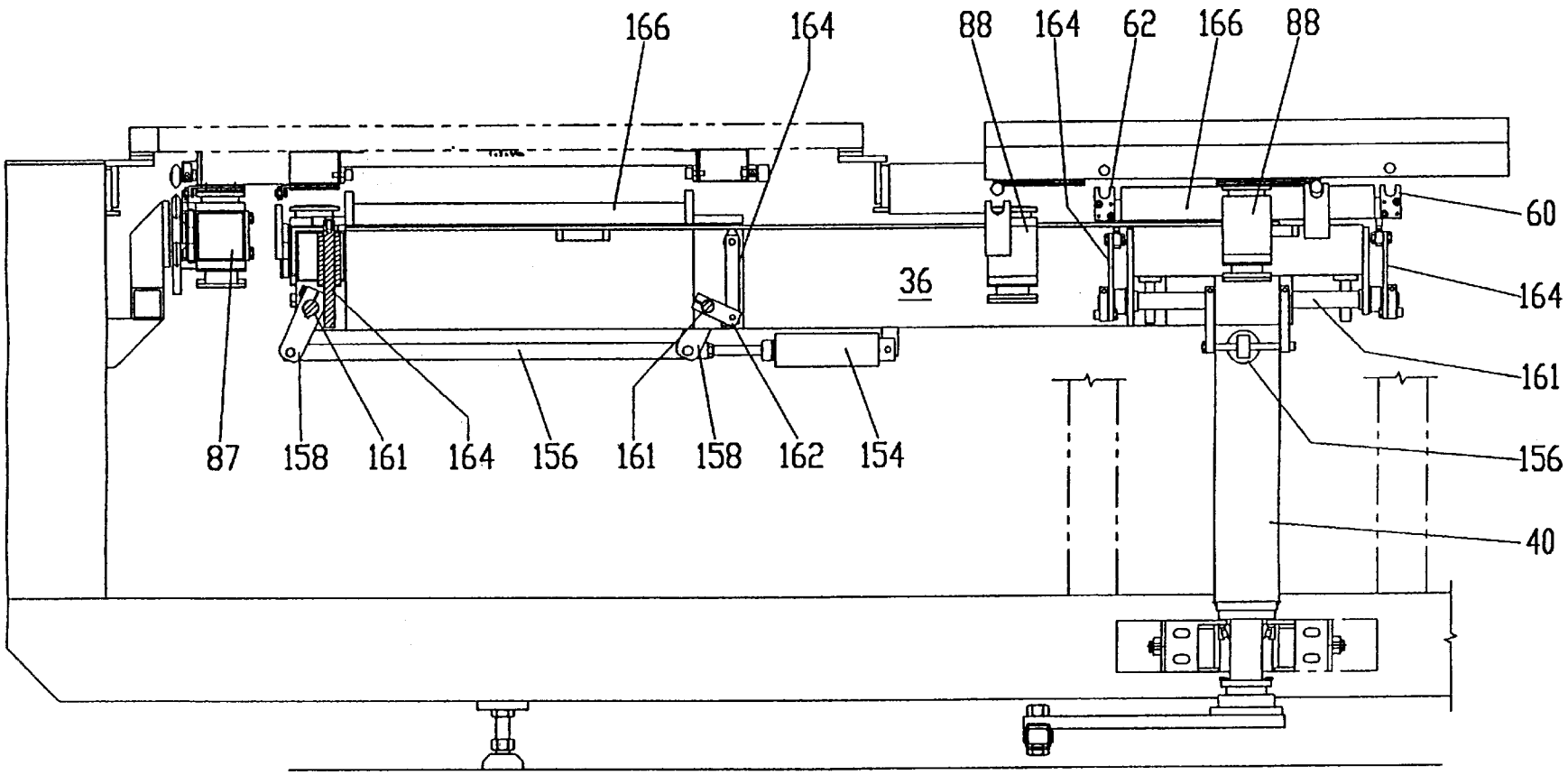
FIG. 11 shows a broken-away side view, partly in vertical cross-section of a table transfer device forming part of the machine of FIGS. 1 through 10.

FIG. 11 shows the mechanisms for raising and lowering the drive members 60 and 62 into and out of engagement with the leading and trailing projections 48 and 50 of the table sub-structures 46 at the transfer mechanisms 55.

For this purpose, a pneumatic piston-and-cylinder device 154 at the underside of the respective drive connector 36 is provided for reciprocating a rod 156 and, thereby, through levers 158, shafts 161, and levers 162 and 164 correspondingly raising and lowering support frames 166, on which the drive members 60 and 62 are mounted.

At each printing station there is provided a printing head indicated generally by reference numeral 160, which bridges the path of travel of the vacuum tables 18, and which is provided with a squeegee and squeegee holder and the flat bar and flat bar holder which are similar to those described in my above-mentioned co-pending U.S. patent application Ser. No. 08/939,407, and which, therefore, are not described in greater detail herein.

Figure 13:
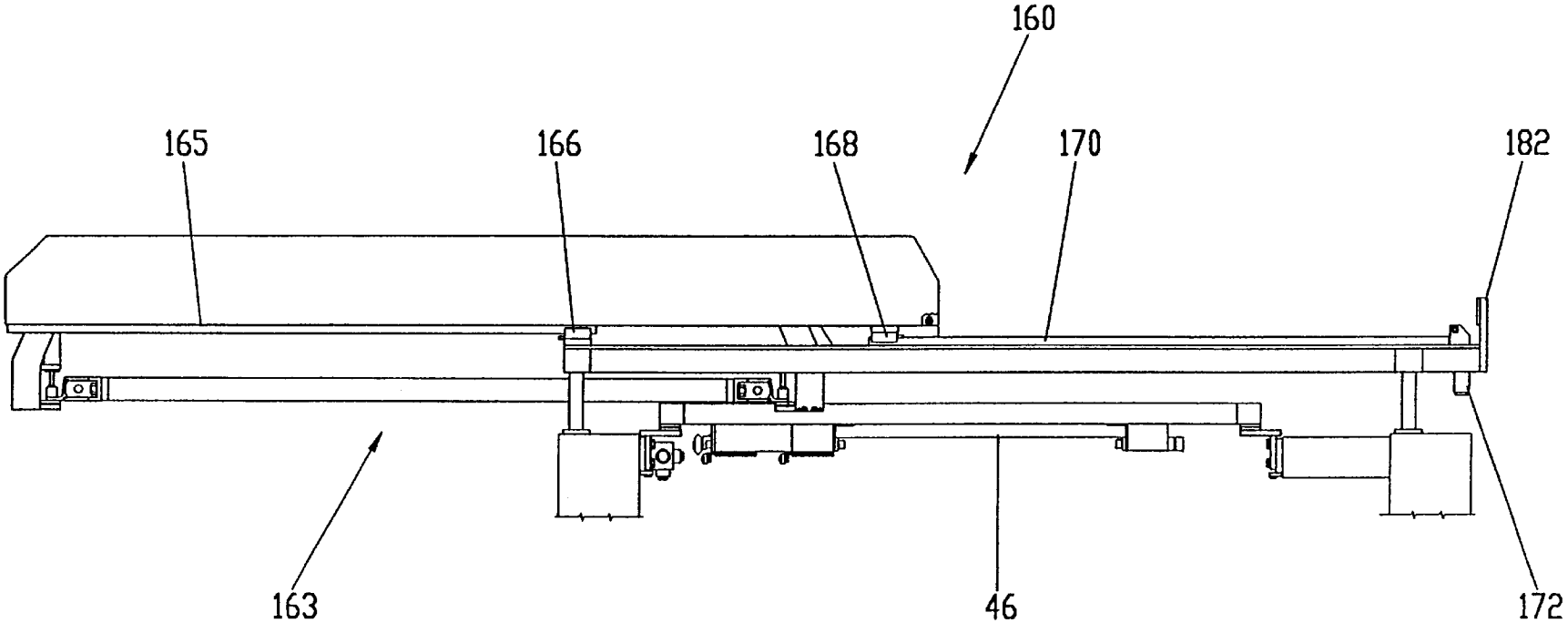
FIG. 13 shows a view in side elevation of parts of a printing station in the machine of FIGS. 1 through 12 in an inoperative condition.
Figure 15:
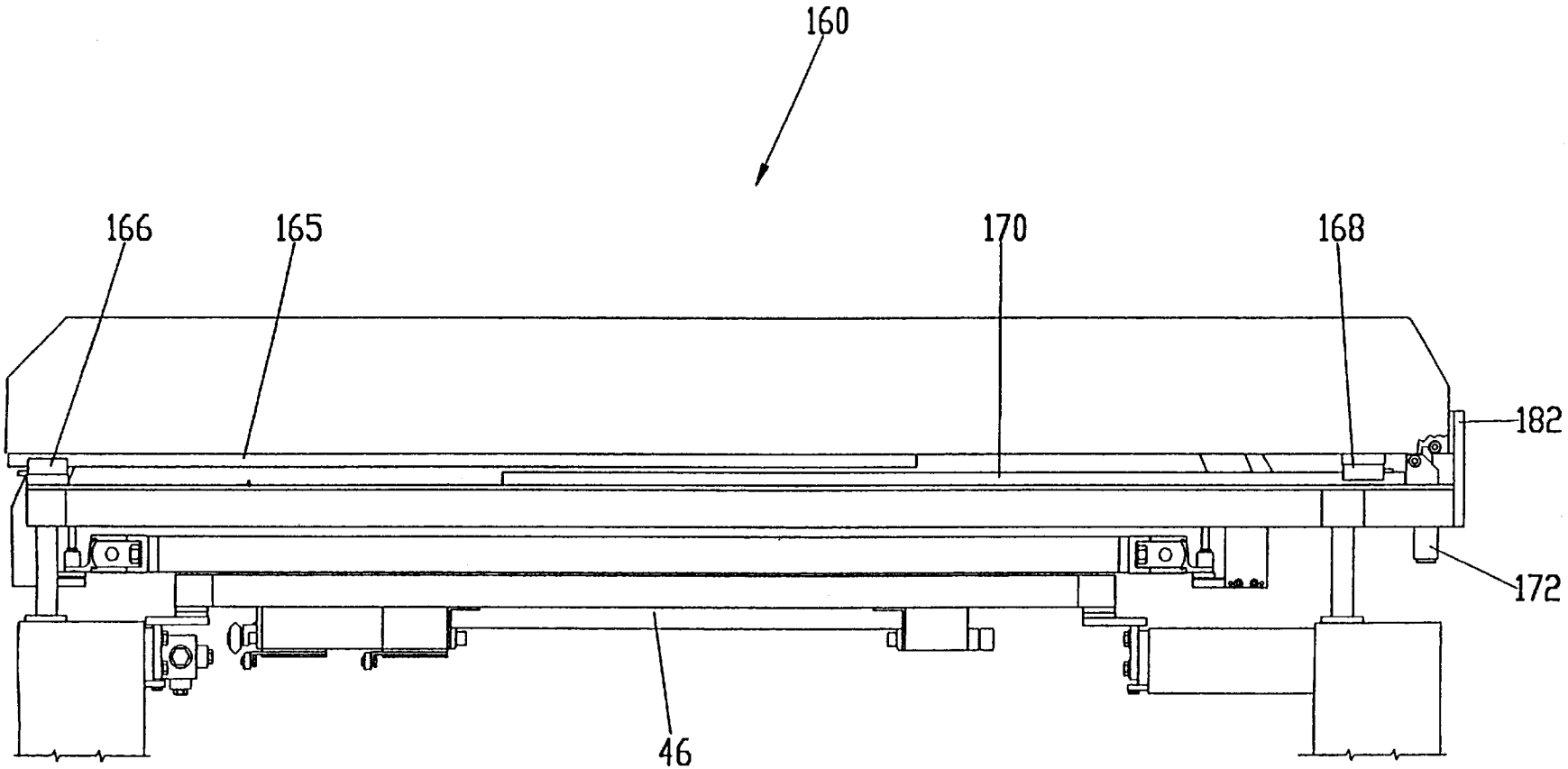
FIG. 15 shows a view corresponding to FIG. 13 but with the printing station in an operative condition.

In the present machine, however, each printing head 160 is horizontally displaceable into an inoperative position, in which the printing head 160 is shown in FIG. 13, from an operative position, in which the printing head 160 is shown in FIG. 15, in order, thus, to provide ready access to a printing screen carried by the printing head and indicated generally by reference numeral 163 in FIG. 13, for the purpose of maintaining or replacing the printing screen 163. For that purpose, rails 165 (FIG. 13) at the underside of the printing head 160 are slidable in guides 166 mounted on the machine frame, and guides 168 on the printing head are slidably engaged with rails 170 mounted on the machine frame.

Figure 16:
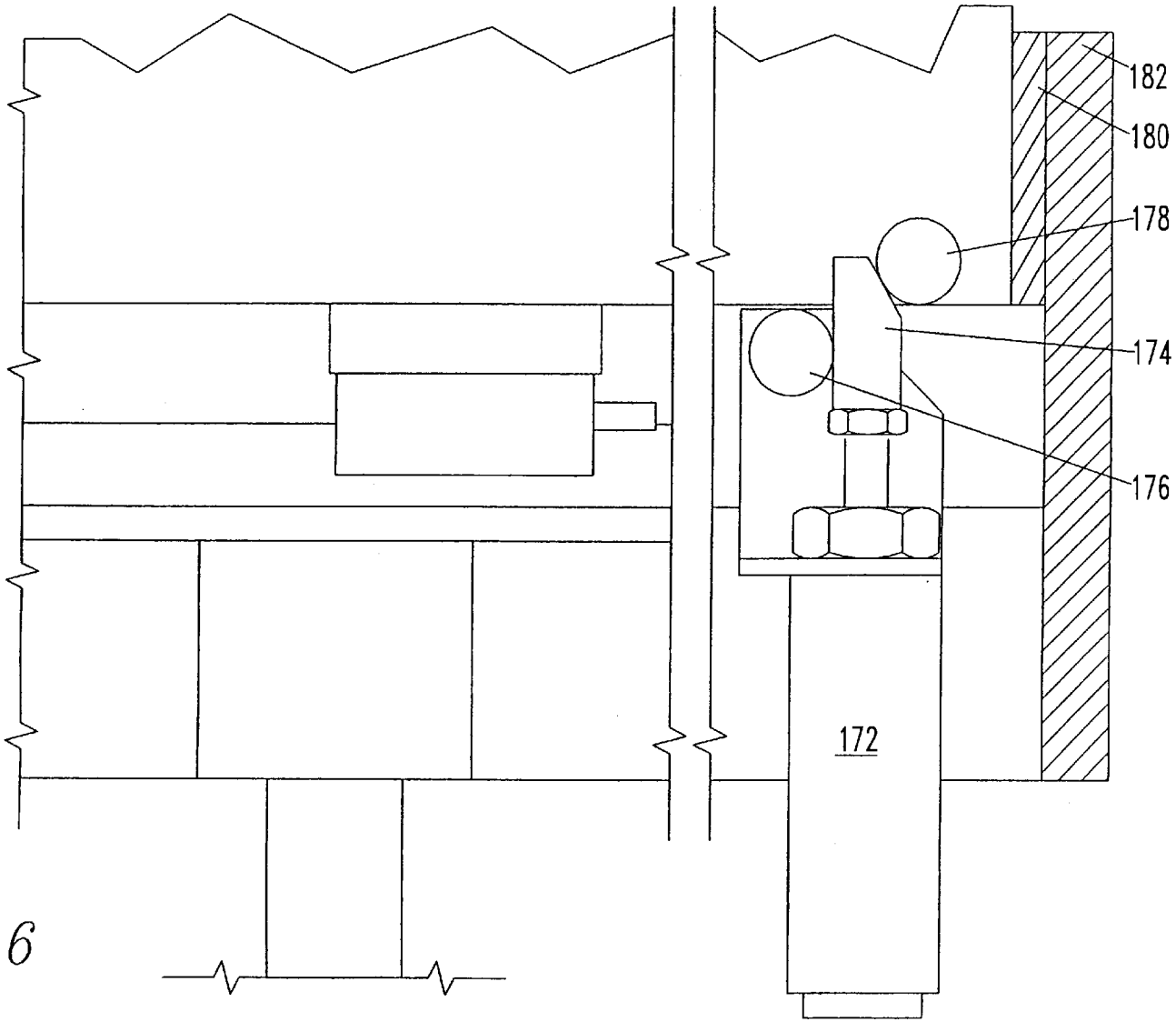
FIG. 16 shows a broken-away view, partly in vertical cross-section, through a locking mechanism forming part of the printing station of FIGS. 13 through 15.

For locking the printing head 160 in its operative position, as shown in FIG. 15, a pair of locking cylinders 172 (FIG. 14) are operable to raise and lower a locking cam 174 (FIG. 16) which, in its raised position, as shown in FIG. 16, engages between rollers 176 and 178 which are mounted, respectively, on the machine frame 12 and on the printing head 160. By engagement with the roller 178, the locking member 174 urges the printing head 160 into firm abutment with a nylon pad 180 on a wall 182 on the machine frame 12, thus ensuring that the printing head 160 is securely and accurately locked in position.

FIGS. 17 through 21 illustrate a modified vacuum ducting arrangement for supplying vacuum to the vacuum tables 18 as the vacuum tables 18 are displaced around their endless path of travel.

Figure 17:
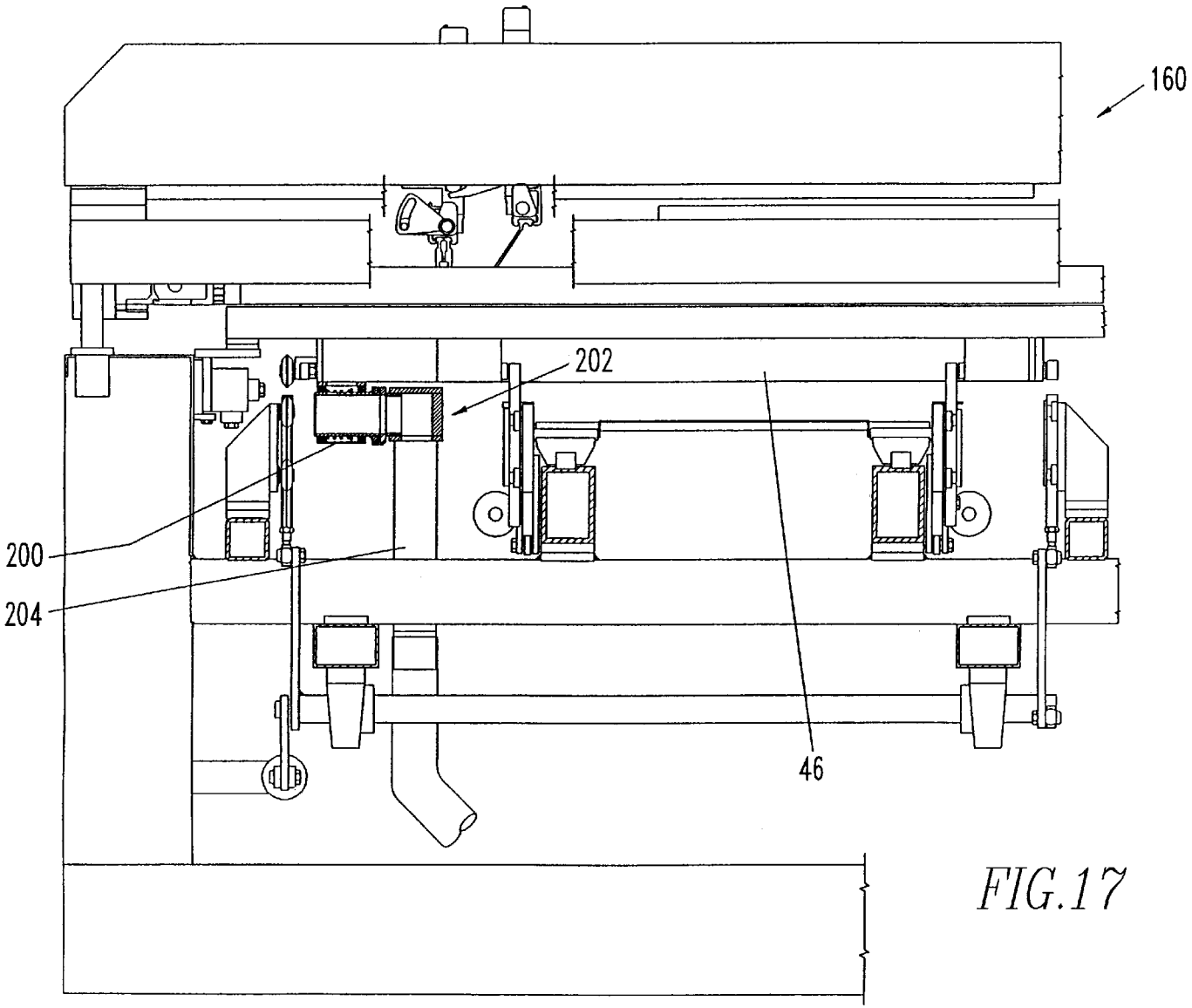
FIG. 17 shows a broken-away view, in vertical cross-section, corresponding to FIG. 7, but showing a modified vacuum ducting system.
Figure 18:
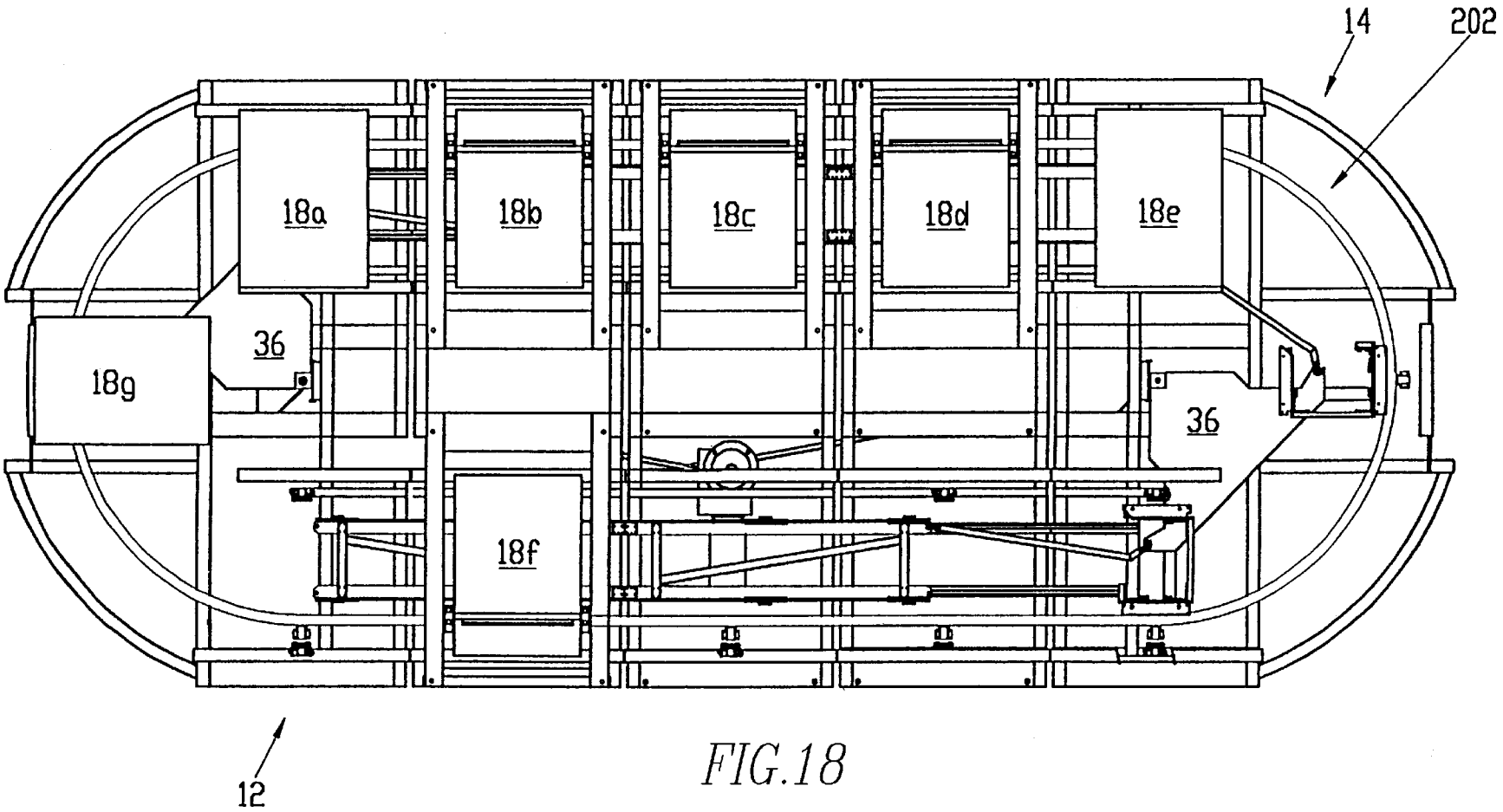
FIG. 18 shows a plan view of the machine, corresponding to FIG. 1, but showing parts of the modified ducting system of FIG. 17.

Referring firstly to FIG. 17, reference numeral 200 indicates generally a vacuum port at the underside of one of the vacuum table sub-structures 46, this vacuum port 200 being urged resiliently in a horizontal direction, as described in greater detail below, towards an endless, horizontally extending vacuum duct, indicated generally by reference numeral 202, which, as will be more readily apparent from FIG. 18, extends around the endless path of travel of the vacuum tables 18. The vacuum duct 202 is connected by a duct 204 to the vacuum pump 148.

Figure 19:
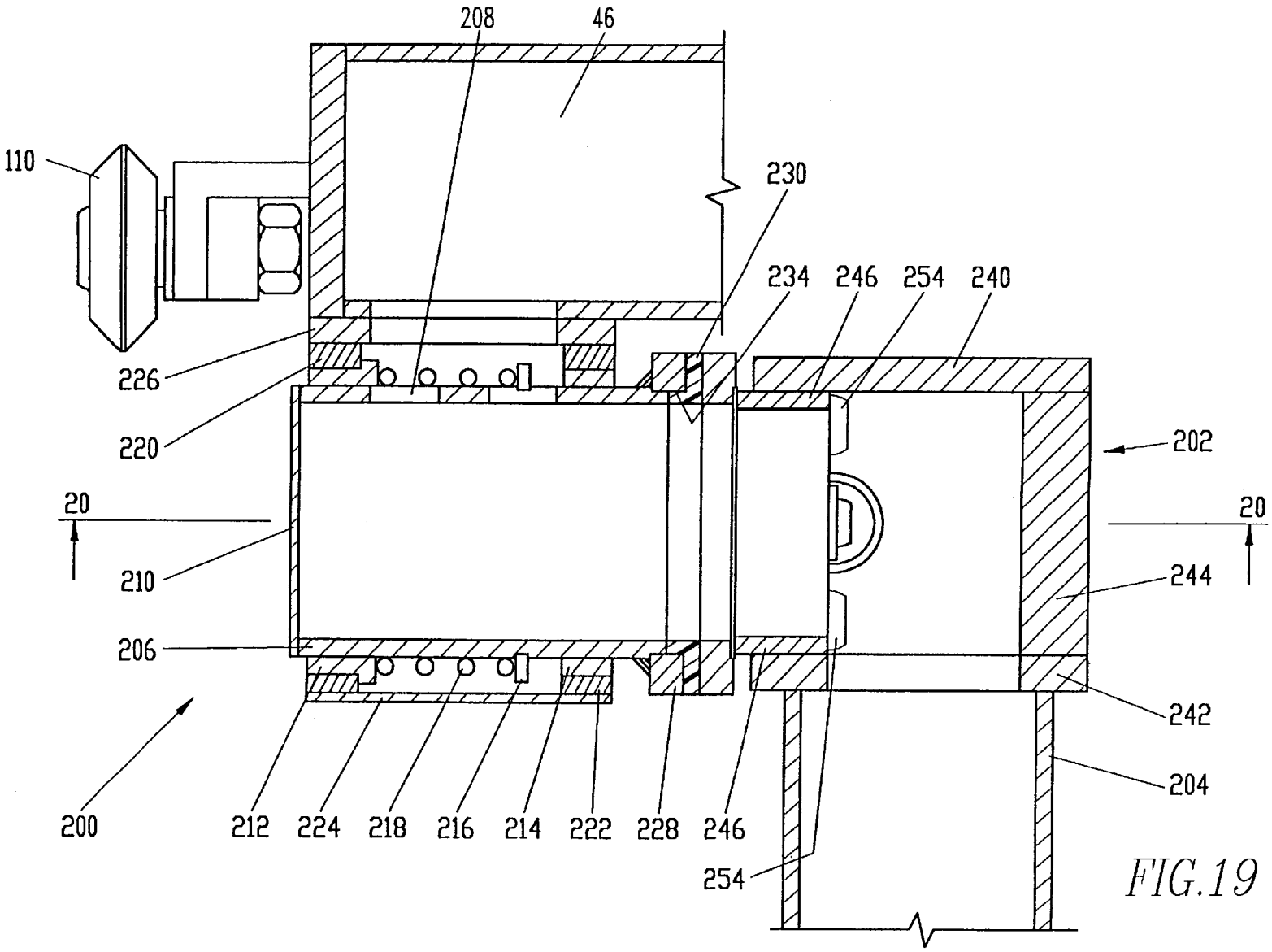
FIG. 19 shows a view taken in vertical cross-section through parts of the modified vacuum ducting system of FIG. 17.
Figure 20:
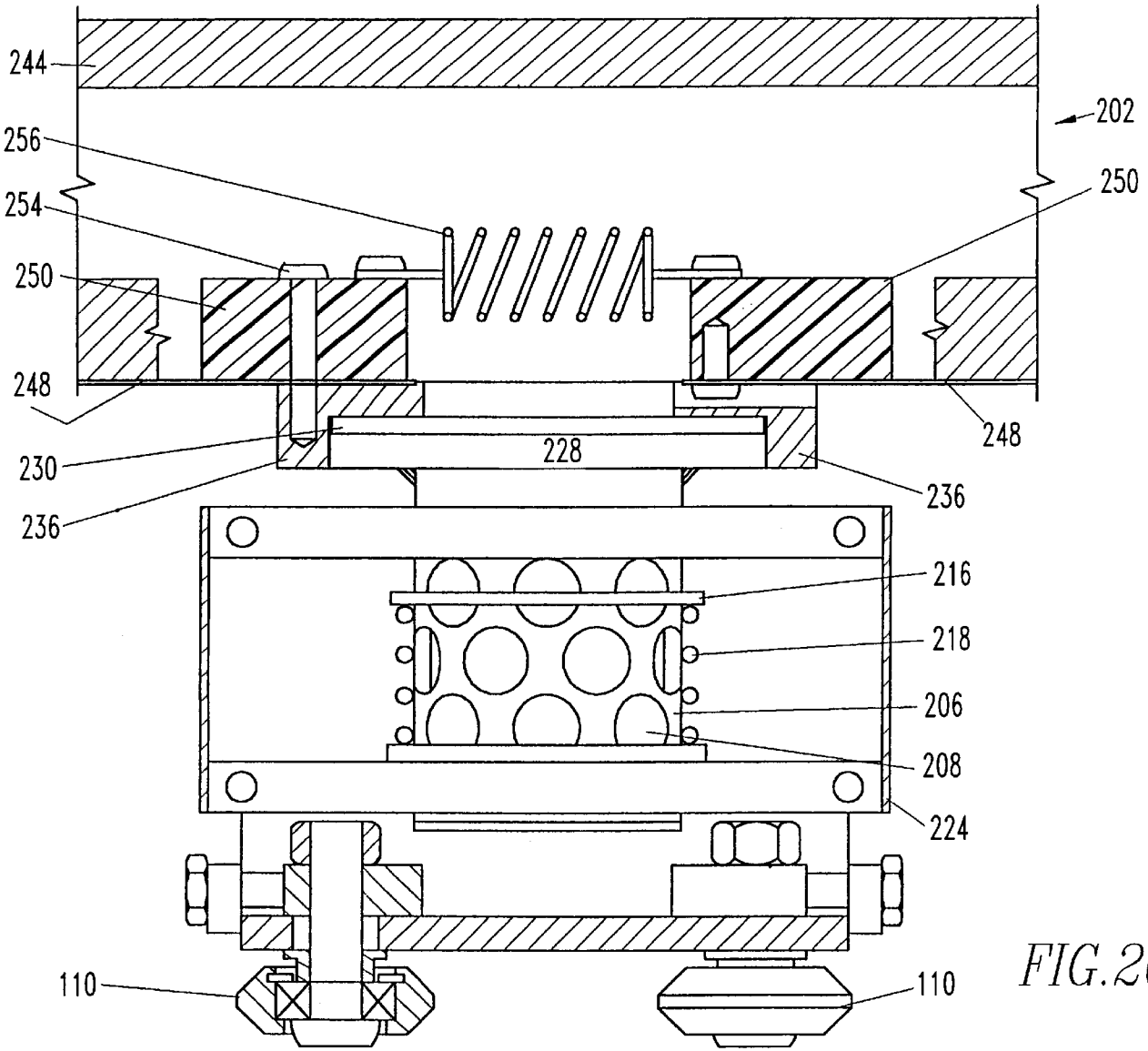
FIG. 20 shows a view taken in cross-section along the line 20—20 of FIG. 19.
Figure 21:
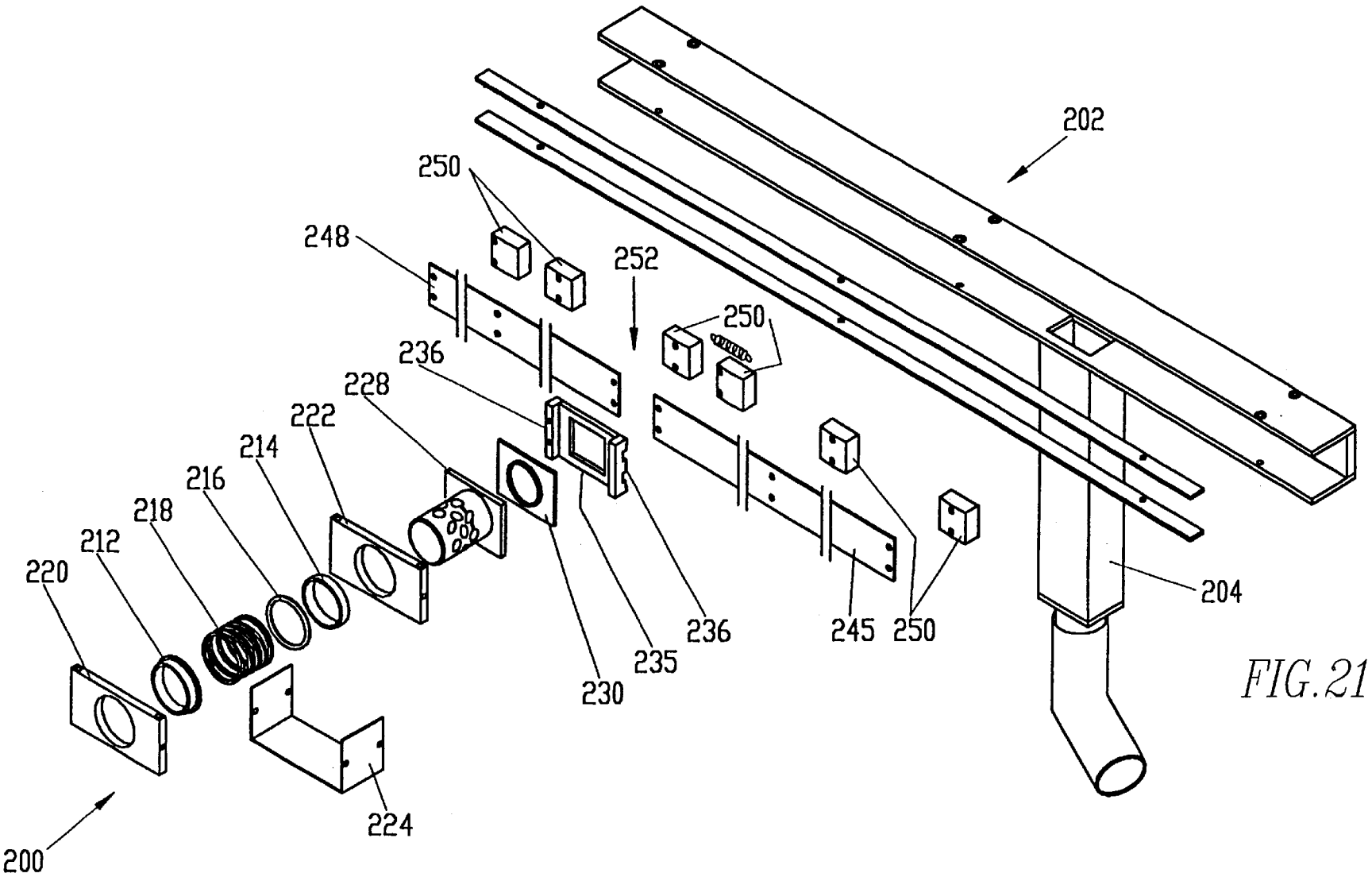
FIG. 21 shows an exploded view in perspective, of parts of the vacuum ducting system of FIGS. 17 through 20.

As shown in FIGS. 19 through 21, the vacuum port 200 comprises a horizontal cylinder 206 which, at its upper side, is formed with openings 208, the cylinder 206 being closed at one end by a circular plate 210. The cylinder 206 is slidably supported, for horizontal sliding movement, in a bronze bushing 212 and a bronze sleeve 214. A retaining ring 216, which is sprung into engagement with the exterior of the cylinder 206, forms an abutment for one end of a helical compression spring 218, the opposite end of which abuts the bushing 212, so that the cylinder 206 is thereby resiliently biased to the right as viewed in FIG. 19. The bushing 212 and the sleeve 214 are fitted into circular openings in rectangular plates 220 and 222 which, together with a housing member 224 (FIG. 21) and an apertured plate 226 at the underside of the table support, form a housing from which opposite ends of the cylinder 206 extend.

The end of the cylinder 206 remote from the end wall plate 210 is welded to a rectangular plate 228, and a cushion plate 230 of plastic material sold under the trade mark DELRIN is fitted onto the plate 228. More particularly, the cushion plate 230 has a circular opening formed with a flange 232, which mates with a circular opening 234 in the plate 228 and abuts the cylinder 206.

The cushion plate 230 is urged, by the compression spring 218, into sliding contact with a generally rectangular component in the form of an apertured rectangular frame 235 which has, at opposite lateral sides thereof, parallel vertical elongate projections 236, between which the cushion plate 230 is received, as apparent from FIG. 20. Consequently, as the table is displaced around the endless path of travel, as described above, the cushion plate 230 and the plate 228, in driving engagement with one of these projections 236, drives the frame 235 around the duct 202. The cushion plate 230 is, however, vertically slidable relative to the frame 235 to allow corresponding vertical movement of the vacuum table 18 at opposite ends of the straight elongate path sections, to allow the vacuum table to be transferred between the carriages 22*a* and 22*b*, as described above.

The vacuum duct 202 is formed by a pair of vertically spaced, horizontal plates 240,242, and a vertical rear wall 244, which thus form a duct which is open at one horizontal side. This open side forms a horizontally elongate opening extending along the vacuum duct 202 and defined by brass strips 246 secured, respectively, to the top and bottom plates 240 and 242 of the duct 202 and projecting laterally from the top and bottom plates 240 and 242, as shown in FIG. 19.

This opening is partially closed by a closure which comprises a plurality of strip metal sections 248, and blocks 250, of DELRIN, which are secured to the strip metal sections 248 and which are engaged between and in sliding contact with the brass strips 246.

Successive strips 248 are separated from one another by gaps, one of which is indicated generally by reference numeral 252 in FIG. 21.

At one side of each gap 252, an end of one of the strip metal sections 248 and one of the blocks 250 are secured to one side of the frame 235 by a pair of screws, of which only one is shown and is indicated by reference numeral 254. However, the opposite side of the frame 235 is not connected to the adjacent end of the next section 248, so that the latter is slidable relative to the frame 235. The ends of the strips 248 at opposite sides of the gap 252 are resiliently connected to one another by means of a helical tension spring 256, as shown in FIG. 20, the spring 256 being one of a plurality of tension springs connecting the strips 248 in this way. The strip metal sections 248 are thus connected to one another to form an endless closure in the form of a belt which travels with the vacuum tables 18 and, by means of these helical compression springs, is tensioned into contact with the vacuum duct 202 so that, even when vacuum within the vacuum duct 202 is interrupted, the closure will be held against the vacuum duct 202 and, more particularly, will be held against the brass strips 246.

Figure 22:
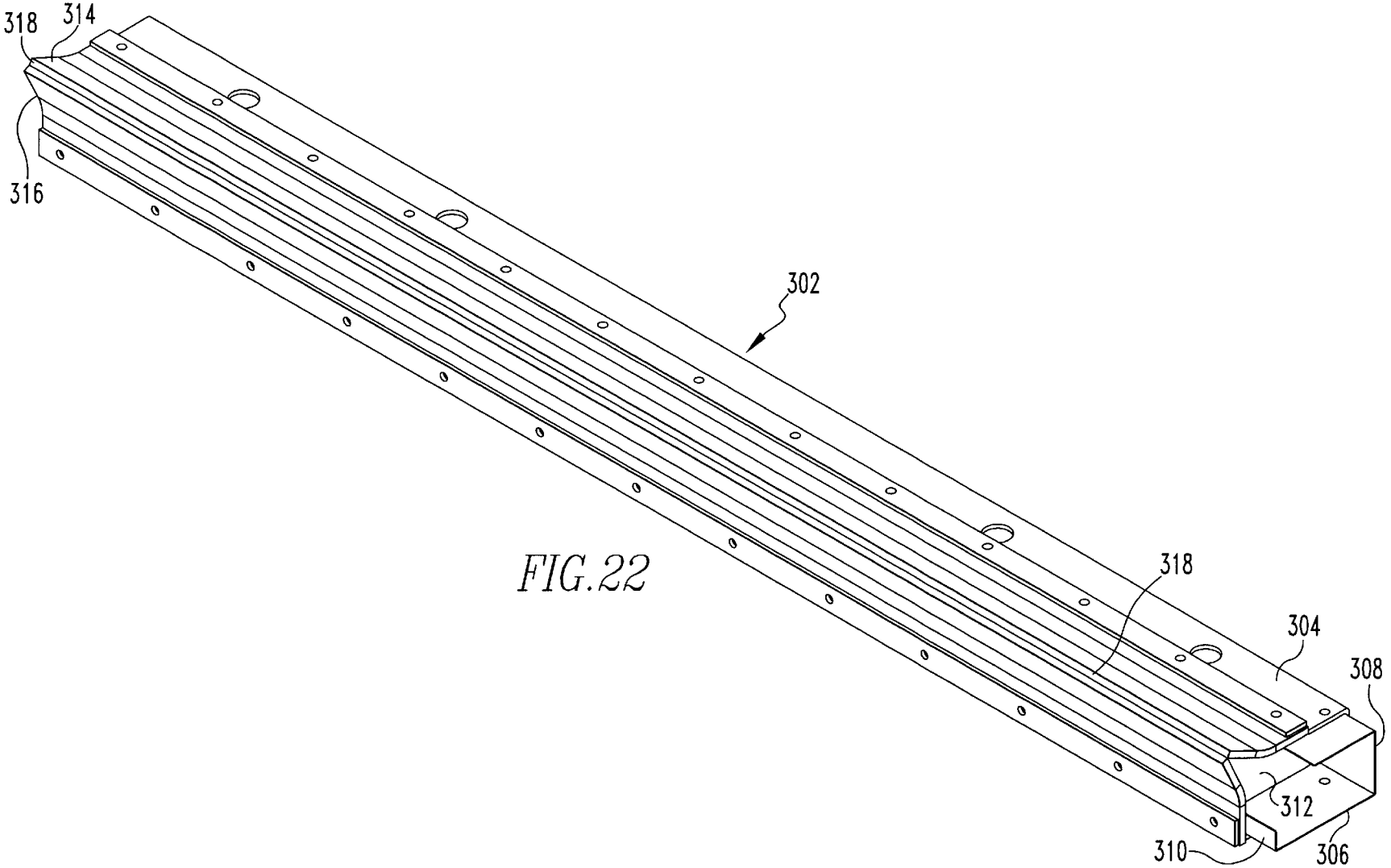
FIG. 22 shows a section of an alternative embodiment of an endless horizontally extending vacuum duct, which is used in conjunction with an alternative embodiment of a vacuum port as shown in FIGS. 23 and 24.
Figure 23:
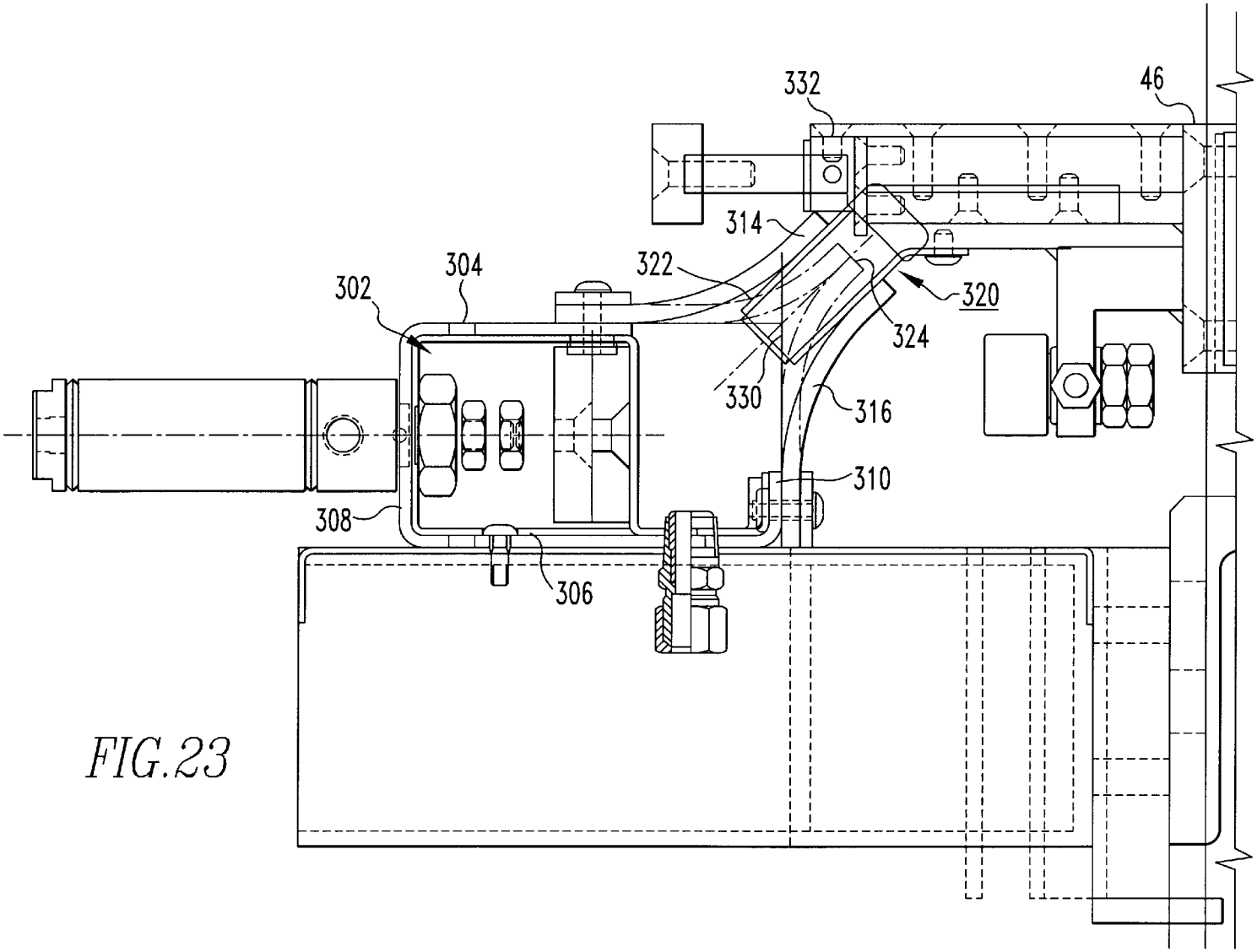
FIG. 23 shows a side elevation view taken in cross-section of an alternative embodiment of a vacuum duct and vacuum port.
Figure 24:
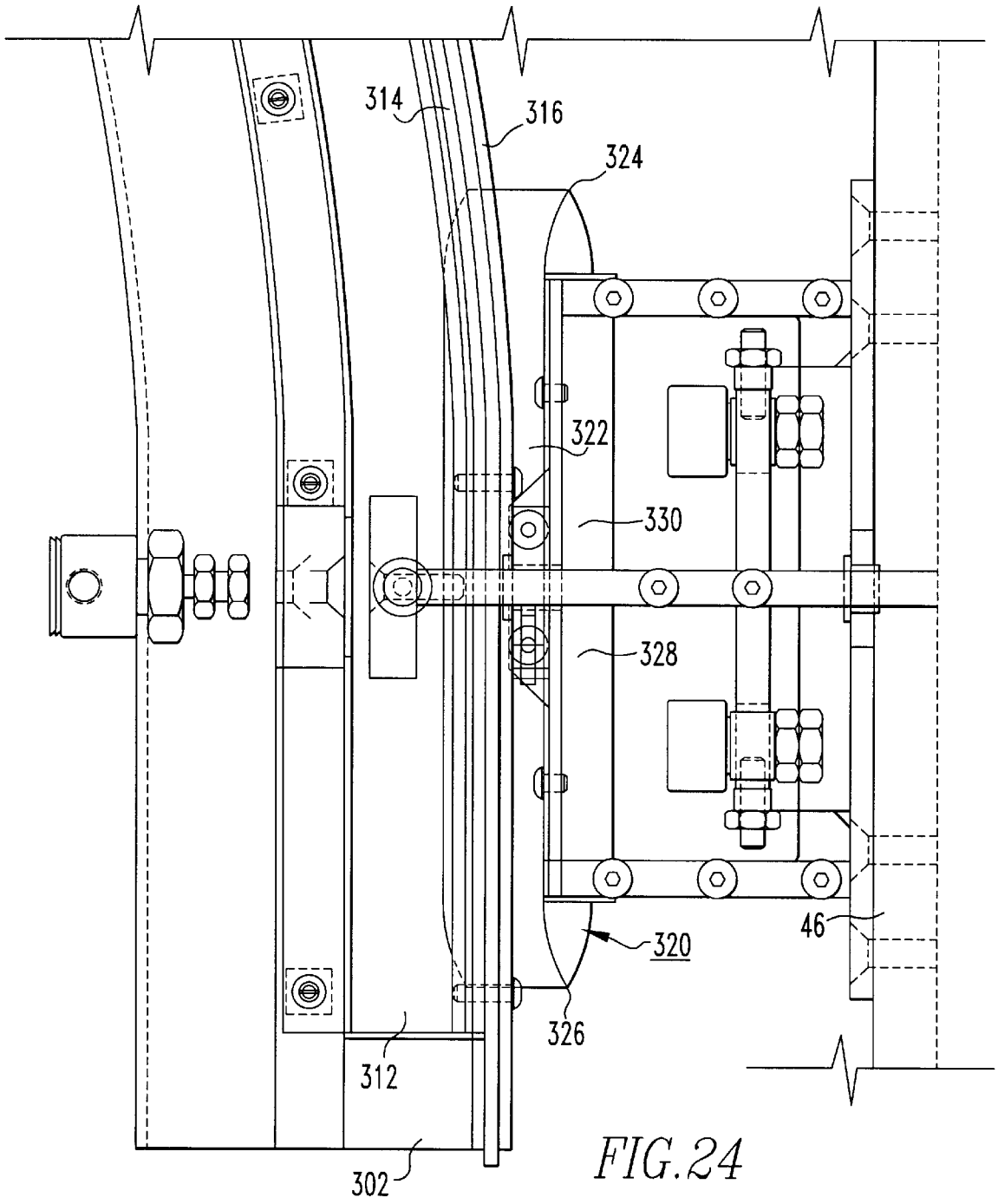
FIG. 24 shows a plan view of the alternative embodiment of the vacuum duct and vacuum port shown in FIG. 23.

Turning to FIGS. 22, 23, and 24, there is illustrated an alternative embodiment of the vacuum delivery system wherein the vacuum tables are in continuous communication with an endless vacuum duct indicated generally by reference numeral 302, a section of which is shown in FIG. 22. The vacuum duct 302 is formed by a pair of horizontally spaced plates 304 and 306 and a vertically disposed wall 308 extending thereinbetween. A partial vertically disposed wall 310 extends upwardly from the plate 306 and defines, in combination with the plate 304, a continuous or substantially continuous open channel 312. First and second flexible members 314 and 316 are positioned to extend over the open channel 312 and provide a means by which the endless vacuum duct 302 is accessed by a vacuum port indicated generally by reference numeral 320 which will be described in conjunction with FIGS. 23 and 24. The flexible members 314 and 316 are manufactured from a material which is resilient and can be positioned so as to maintain a biased relationship at their juncture 318 where the members 314 and 316 are in separable contact, one with the other. The flexible members are thus positioned so as to define a means for continuous access to the vacuum duct 302, but that continuous access defined by the juncture 318 is biased in a normally closed position. As will be appreciated by those skilled in the art, the physical layout of the vacuum ducts 202 and 302 is consistent with the endless path of travel of the vacuum tables 18 as shown in FIG. 18. In another advantage of this alternative embodiment, sections of endless vacuum duct 302 can be manufactured individually and joined together by suitable fastening means. Moreover, the substantial reduction of moving and movable parts in this alternative embodiment simplifies manufacture and maintenance of this vacuum system.

Turning to FIGS. 23 and 24, the operation of this alternative vacuum duct system can be appreciated in side elevation and plan view. A description of the structure and general operation of a vacuum table 18 is described in detail above in connection with FIG. 6 and reference is made thereto. Generally, vacuum is communicated through the hollow interior of the table sub-structure 46. In the alternative embodiment, a movable vacuum duct as at 98 in FIG. 1 is secured to the respective carriage 22*a*, 22*b*. The alternative vacuum port 320 as shown in FIGS. 23 and 24 comprises a member 322 with a leading edge 324 and a trailing edge 326. The leading and trailing edges 324 and 326 define a knife-edge like structure which engages the juncture 318 where the flexible members 314 and 316 are in separable contact, one with the other. As the vacuum port 320 travels along the length of the vacuum duct 302, the leading edge 324 of the vacuum port continuously opens the juncture while the trailing edge 326 facilitates the smooth closure of the temporarily separated flexible members 314 and 316.

The center portion 328 of the member 322 is disposed between the leading and trailing edges 324 and 326 and defines port means 330 by which a vacuum is communicated between the vacuum duct 302 and the hollow interior of the table sub-structure 46 by means of the parted juncture of the flexible members 314 and 316. The vacuum port 320 is supported by a housing 332 mounted onto the table sub-structure 46. Thus, as the tables are conveyed about the endless track, the table sub-structure remains in fluid communication with the vacuum system by means of the vacuum port 320 which by its continuous movement establishes a continuously moving access point to the vacuum duct 302. The vacuum duct 302 is connected to a connecting duct 334 and to a vacuum pump such as shown in connection with the vacuum system illustrated in FIG. 17. The afore-described system minimizes loss of vacuum while at the same time continuously maintaining communication between the vacuum duct 302 and the table sub-structure 46.

I claim:

1. A screen printing machine, comprising:

a plurality of vacuum tables for supporting articles to be printed;

a displacement mechanism for displacing said vacuum tables in succession around an endless path of travel;

said endless path of travel including a pair of parallel elongate path sections;

a plurality of printing stations distributed along said elongate path sections and each having a printing head;

said vacuum tables each having a top support surface, a plurality of perforations in said top support surface, a hollow interior space and a vacuum port communicating through said hollow interior space with said perforations;

said displacement mechanism comprising tracks extending along said elongate path sections, elongate reciprocatable carriages mounted on said tracks for longitudinal movement along said track, a drive operable to reciprocate said carriages to and fro along said tracks and drive members provided on said carriages and engageable with said vacuum tables for moving said vacuum tables, in accordance with the reciprocation of said carriages, in succession to said printing stations;

a vacuum duct system comprising vacuum connectors and an endless duct having a first and second flexible members which provide a means for connecting said endless duct to said vacuum ports of said vacuum tables; and a vacuum pump connected to said vacuum system.

2. A screen printing machine as claimed in claim 1, wherein said vacuum table vacuum port comprises a member with a leading edge and a trailing edge which cooperate with the first and second flexible members of said endless duct to effect communication between said vacuum port and said endless duct.

3. A screen printing machine as claimed in claim 2, wherein said member with a leading edge and a trailing edge includes a hollow interior portion whereby vacuum is communicated from said endless duct and said vacuum port.

4. A screen printing machine as claimed in claim 1, wherein said drive includes, at opposite ends of said elongate path sections, drive connections to said carriages, said drive connections comprising horizontally pivotable drive connectors, pivots permitting pivotation of said drive connectors to and fro about respective vertical axes, links extending between said drive connectors and at least one of said carriages and pivot connections connecting said links to said carriages and to said drive connectors.

5. A screen printing machine as claimed in claim 1, wherein said elongate path sections have input and output ends, said vacuum tables have leading and trailing projections engageable by said drive members, said drive members are positioned to engage said trailing projections at output ends of said elongate path sections, and said drive connectors have first drive members engageable with said leading projections between first positions at said output ends of said elongate path sections and intermediate positions between said carriages and second drive members engageable with said trailing projections between said intermediate positions and said input ends of said elongate path sections.

6. A screen printing machine as claimed in claim 1, wherein said drive includes drive connections to said carriages, said drive connections comprising horizontally pivotable drive connectors, pivots permitting pivotation of said drive connectors to and fro about respective vertical axes, links extending between said drive connectors and said carriages and pivot connections connecting said links to said carriages and to said drive connectors.

* * * * *